US008241744B2

(12) United States Patent
Kikuchi et al.

(10) Patent No.: US 8,241,744 B2
(45) Date of Patent: Aug. 14, 2012

(54) SURFACE-TREATED METAL MATERIAL AND PRODUCING METHOD THEREOF

(75) Inventors: Ikuo Kikuchi, Tokyo (JP); Kimitaka Hayashi, Tokyo (JP); Yoshio Kimata, Tokyo (JP); Atsushi Morishita, Tokyo (JP); Taihei Kaneto, Tokyo (JP); Shinji Nomura, Hiratsuka (JP); Hidehiro Yamaguchi, Kitayushu (JP)

(73) Assignee: Nippon Steel Corporation, Tokyo (JP)

( * ) Notice: Subject to any disclaimer, the term of this patent is extended or adjusted under 35 U.S.C. 154(b) by 455 days.

(21) Appl. No.: 12/312,429

(22) PCT Filed: Nov. 14, 2007

(86) PCT No.: PCT/JP2007/072116

§ 371 (c)(1),
(2), (4) Date: Jul. 15, 2009

(87) PCT Pub. No.: WO2008/059890

PCT Pub. Date: May 22, 2008

(65) Prior Publication Data

US 2010/0003529 A1 Jan. 7, 2010

(30) Foreign Application Priority Data

Nov. 15, 2006 (JP) ..... 2006-309614

(51) Int. Cl.

| | |
|---|---|
| ***B32B 15/08*** | (2006.01) |
| ***B05D 3/02*** | (2006.01) |
| *C23C 22/36* | (2006.01) |
| *C23C 22/42* | (2006.01) |
| *C23C 22/44* | (2006.01) |

(52) U.S. Cl. ..... 428/327; 427/387; 427/388.1; 427/388.2; 428/341; 428/450

(58) Field of Classification Search ..... 427/387, 427/388.1, 388.2; 428/327, 341, 450
See application file for complete search history.

(56) References Cited

U.S. PATENT DOCUMENTS

| | | | | |
|---|---|---|---|---|
| 5,292,549 | A | 3/1994 | van Ooiji et al. | 427/156 |
| 5,427,632 | A | 6/1995 | Dolan | 148/259 |
| 6,733,579 | B1 | 5/2004 | Gorecki | 106/287.11 |
| 2001/0037748 | A1 | 11/2001 | Shimakura et al. | 106/14.44 |
| 2005/0037227 | A1 | 2/2005 | Endo et al. | 428/624 |
| 2009/0110921 | A1 | 4/2009 | Kaneto et al. | 428/341 |

FOREIGN PATENT DOCUMENTS

| | | |
|---|---|---|
| CN | 1332213 | 1/2002 |
| CN | 1594472 | 3/2005 |
| DE | 197 54 108 | 6/1999 |
| EP | 0 949 353 | 10/1999 |
| EP | 1 426 466 | 6/2004 |
| JP | 08-073775 | 3/1996 |
| JP | 2001-335954 | 12/2001 |
| JP | 2001-526324 | 12/2001 |
| JP | 2002-030460 | 1/2002 |
| JP | 2003-105562 | 4/2003 |
| RU | 2 009 270 | 3/1994 |
| RU | 2 148 678 | 5/2000 |
| WO | WO 99/29927 | 6/1999 |
| WO | 01/12876 | 2/2001 |

OTHER PUBLICATIONS

International Search Report dated Jan. 15, 2008 issued in corresponding PCT Application No. PCT/JP2007/072116.
Final Office Action dated Sep. 21, 2011, issued in U.S. Appl. No. 11/989,096, corresponding to US 2009/0110921.
European Search Report dated May 20, 2011, issued in European Patent Application No. EP 06 78 1396.

*Primary Examiner* — D. S. Nakarani
(74) *Attorney, Agent, or Firm* — Kenyon & Kenyon LLP

(57) ABSTRACT

This surface-treated metal material includes a composite film obtained by applying a metal surface treatment agent on a surface of a metal material and drying the metal surface treatment agent, the metal surface treatment agent containing: an organic silicon compound (W) obtained by combining a silane coupling agent (A) containing one amino group in a molecule and one glycidyl group in a molecule, at a solid content mass ratio [(A)/(B)] of 0.7 to 1.7; at least one kind of fluorine compound (X) selected from titanium hydrofluoric acid and zirconium hydrofluoric acid; a phosphoric acid (Y); a vanadium compound (Z); and at least one kind of lubricant (J).

5 Claims, No Drawings

SURFACE-TREATED METAL MATERIAL AND PRODUCING METHOD THEREOF

TECHNICAL FIELD

The present invention relates to a surface-treated metal material and a producing method thereof, and more particularly, to a metal material subjected to a chrome free surface treatment that is excellent in corrosion resistance, heat resistance, solvent resistance, a paintability, a sliding mobility, damage resistance at the time of forming, and dreg resistance, and a producing method thereof.

Priority is claimed on Japanese Patent Application No. 2006-309614, the contents of which are incorporated herein by reference.

BACKGROUND ART

Generally, there has been used a method of performing a chromate treatment on a metal material surface by the use of a process liquid having excellent adhesion to a metal material surface and mainly including chromic acid, dichromic acid, or salts thereof, as a technique for providing corrosion resistance, fingerprint resistance, or the like to the metal material surface.

Recently, considering that a chromate treatment film includes a large amount of noxious hexavalent chrome, a surface treatment technique using a non-chrome base usable as a substitute of a chromate film has been developed due to concern about environment. As such a non-chrome based surface treatment technique, for example, there have been known for practical use, a method of applying a treatment using inorganic components, a method of applying a phosphate treatment, a method of applying a treatment using an elementary substance of silane coupling agent, a method of applying a organic resin coating treatment, and the like.

As a technique mainly using inorganic components, for example, in Patent Document 1, there is disclosed a treatment using a metal surface treatment agent containing a vanadium compound; and a metal compound including at least one kind of metal selected from the groups including zirconium, titanium, molybdenum, tungsten, manganese, and cerium.

As a technique mainly using silane coupling agent, for example, in Patent Document 2, there is disclosed a treatment of a metal sheet using an aqueous solution containing an organic functional silane with low concentration and a cross-linking agent, to provide temporary corrosion protection. Also, in Patent Document 2, there is described a method in which the cross-linking agent cross-links the organic functional silane, thereby forming a dense siloxane film.

For example, in Patent Document 3, there is disclosed a method of producing a non-chrome based steel sheet having excellent corrosion resistance and having excellent fingerprint resistance, blackening resistance, and coating adhesion by applying a surface treatment agent containing a specified resin compound (A), a cationic urethane resin (B) having at least one kind of cationic functional group selected from primary to tertiary amino groups and a quaternary ammonium base, one or more kinds of silane coupling agents (C) having a specified reactive functional group, and a specified acid compound (E), in which the contents of the cationic urethane resin (B) and the silane coupling agent (C) fall within predetermined ranges.

[Patent Document 1] Japanese Unexamined Patent Application, First Publication No. 2002-30460

[Patent Document 2] U.S. Pat. No. 5,292,549

[Patent Document 3] Japanese Unexamined Patent Application, First Publication No. 2003-105562

DISCLOSURE OF THE INVENTION

Problems to be Solved by the Invention

However, the known techniques do not satisfy all of corrosion resistance, heat resistance, fingerprint resistance, solvent resistance, a paintability, a sliding mobility, damage resistance at the time of forming, and dreg resistance. In addition, the known techniques still have a problem in practical use.

As described above, a surface treatment agent usable as a substitute of a chromate film cannot have ever been obtained by any method since recent. Accordingly, it has been demanded to develop a surface treatment agent and a treatment method thereof, which can totally satisfy all of them.

The present invention has been made to solve the aforementioned problems, and has an object of providing a metal material subjected to a chrome free surface treatment that can satisfy all of corrosion resistance, heat resistance, fingerprint resistance, solvent resistance, a paintability, a sliding mobility, damage resistance at the time of forming, and dreg resistance.

Means for Solving the Problems

The inventors have made a close study to solve the aforementioned problems. As a result, the inventor has found that an aqueous metal surface treatment agent which is obtained by combining two kinds of specific silane coupling agents, including an organic silicon compound (W) containing two or more specific functional groups and one or more specific hydrophilic functional groups, a fluorine compound (X), a phosphoric acid (Y), a vanadium compound (Z), and a lubricant (J) is applied onto a surface of a metal material and is dried to form a composite film containing the components, thereby obtaining a chromate free surface-treated metal material that can satisfy all of corrosion resistance, heat resistance, fingerprint resistance, solvent resistance, a paintability, a sliding mobility, damage resistance at the time of forming, and dreg resistance. Consequently, the inventors have made the present invention.

A surface-treated metal material of the invention includes a composite film formed on a surface of a metal material, the composite film containing: an organic silicon compound (W) having two or more functional groups (a) represented by Formula $SiR^1R^2R^3$ (where each of $R^1$, $R^2$ and $R^3$ represents an alkoxy group or a hydroxyl group independently from each other, and at least one of them represents an alkoxy group) and one or more hydrophilic functional group (b) of at least one kind selected from a hydroxyl group (a hydroxyl group different from what can be included in the functional group (a)) and an amino group, in a molecule, the organic silicon compound (W) having an average molecular weight of 1000 to 10000; at least one kind of fluorine compound (X) selected from titanium hydrofluoric acid and zirconium hydrofluoric acid; a phosphoric acid (Y); a vanadium compound (Z); and at least one kind of lubricant (J) selected from the group consisting of water dispersible polyethylene wax, polypropylene wax, and polytetrafluoroethylene and has a number average particle size of 0.01 μm to 1.0 μm and a softening temperature of 100° C. or more. The organic silicon compound (W) is obtained by combining a silane coupling agent (A) containing one amino group in a molecule and a silane coupling agent (B) containing one glycidyl group in a molecule, at a solid content mass ratio [(A)/(B)] of 0.5 to 1.7. Ratios of components of the composite film satisfy the following conditions (1) to (5), respectively:

(1) a solid content mass ratio [(X)/(W)] of the organic silicon compound (W) and the fluorine compound (X) is in the range of $0.02 \leqq [(X)/(W)] \leqq 0.07$, (2) a solid content mass ratio [(Y)/(W)] of the organic silicon compound (W) and the phosphoric acid (Y) is in the range of $0.03 \leqq [(Y)/(W)] \leqq 0.12$, (3) a solid content mass ratio [(Z)/(W)] of the organic silicon compound (W) and the vanadium compound (Z) is in the range of $0.05 \leqq [(Z)/(W)] \leqq 0.17$, (4) a solid content mass ratio [(Z)/(X)] of the fluorine compound (X) and the vanadium compound (Z) is in the range of $1.3 \leqq [(Z)/(X)] \leqq 6.0$, and (5) a solid content mass ratio [(J)/(W+X+Y+Z)] of the lubricant (J); and the organic silicon compound (W), the fluorine compound (X), the phosphoric acid (Y), and the vanadium compound (Z) is in the range of $0.02 \leqq [(J)/(W+X+Y+Z)] \leqq 0.12$.

The composite film may further contain at least one kind of cobalt compound (C) selected from the group consisting of cobalt sulfate, cobalt nitrate, and cobalt carbonate, in which a solid content mass ratio [(C)/(W)] of the organic silicon compound (W) and the cobalt compound (C) is in the range of 0.01 to 0.1.

Film weight of the composite film after drying may be in the range of 0.05 $g/m^2$ to 2.0 $g/m^2$.

The metal material may be a zinc-based plated steel sheet.

A method of producing a surface-treated metal material of the invention includes the steps of: applying an aqueous metal surface treatment agent satisfying the following conditions (1) to (7) onto a surface of a metal material; and drying the aqueous metal surface treatment agent at an arrival temperature of the sheet more than 50° C. and less than 250° C. so that a film weight is in the range of 0.05 to 2.0 $g/m^2$.

(1) the aqueous metal surface treatment agent contains an organic silicon compound (W) having two or more functional groups (a) represented by Formula $SIR^1R^2R^3$ (where each of $R^1$, $R^2$ and $R^3$ represents an alkoxy group or a hydroxyl group independently from each other, and at least one of them represents an alkoxy group) and one or more hydrophilic functional group of at least one kind (b) selected from a hydroxyl group (a hydroxyl group different from what can be included in the functional group (a)) and an amino group, in a molecule, the organic silicon compound (W) having an average molecular weight of 1000 to 10000; at least one kind fluorine compound (X) selected from titanium hydrofluoric acid and zirconium hydrofluoric acid; a phosphoric acid (Y); a vanadium compound (Z); and at least one kind lubricant (J) selected from the group consisting of water dispersible polyethylene wax, polypropylene wax, and polytetrafluoroethylene and has a number average particle size of 0.01 μm to 1.0 μm and a softening temperature of 100° C. or more, (2) the organic silicon compound (W) is obtained by combining a silane coupling agent (A) containing one amino group in a molecule and a silane coupling agent (B) containing one glycidyl group in a molecule, at a solid content mass ratio [(A)/(B)] of 0.5 to 1.7, (3) a solid content mass ratio [(X)/(W)] of the organic silicon compound (W) and the fluorine compound (X) is in the range of $0.02 \leqq [(X)/(W)] \leqq 0.07$, (4) a solid content mass ratio [(Y)/(W)] of the organic silicon compound (W) and the phosphoric acid (Y) is in the range of $0.03 \leqq [(Y)/(W)] \leqq 0.12$, (5) a solid content mass ratio [(Z)/(W)] of the organic silicon compound (W) and the vanadium compound (Z) is in the range of $0.05 \leqq [(Z)/(W)] \leqq 0.17$, (6) a solid content mass ratio [(Z)/(X)] of the fluorine compound (X) and the vanadium compound (Z) is in the range of $1.3 \leqq [(Z)/(X)] \leqq 6.0$, and (7) a solid content mass ratio [(J)/(W+X+Y+Z)] of the lubricant (J) and the components except the lubricant (J) is in the range of $0.02 \leqq [(J)/(W+X+Y+Z)] \leqq 0.12$.

Effects of the Invention

It is possible to provide a surface-treated metal material that can satisfy all of corrosion resistance, heat resistance, fingerprint resistance, solvent resistance, a paintability, a sliding mobility, damage resistance at the time of forming, and dreg resistance.

BEST MODE FOR CARRYING OUT THE INVENTION

Hereinafter, an embodiment according to the invention will be described in detail.

Metal materials applicable to the invention are not limited particularly. For example, the materials may be iron, iron based alloy, aluminum, aluminum based alloy, copper, copper based alloy, and the like. In addition, a plated metal material obtained by plating a predetermined material may be used. A zinc based plated steel sheet is most suitable for the invention among various kinds of metal material. The zinc based plated steel sheet may be a zinc plated steel sheet, a zinc-nickel plated steel sheet, a zinc-iron plated steel sheet, a zinc-chrome plated steel sheet, a zinc-aluminum plated steel sheet, a zinc-titanium plated steel sheet, a zinc-magnesium plated steel sheet, a zinc-manganese plated steel sheet, a zinc-aluminum-magnesium plated steel sheet, a zinc-aluminum-magnesium-silicon plated steel sheet, and the like. As a small amount of different metal elements or impurities, such a plated layer may include cobalt, molybdenum, tungsten, nickel, titanium, chrome, aluminum, manganese, iron, magnesium, lead, bismuth, antimony, tin, copper, cadmium, arsenic, and the like. Inorganic materials such as silica, alumina, and titania may be dispersed in such a plated layer. In addition, the invention is applicable to multi-layer plating in which plating (e.g., iron plating, iron-phosphorus plating, nickel plating, and cobalt plating) different from the aforementioned plating is combined. A plating method is not limited particularly, and, may be preferably be any method of the known electroplating method, melting plating method, deposition plating method, dispersion plating method, and vacuum plating method.

In the chromate free surface-treated metal material of the invention, an organic silicon compound (W) that is an essential component of an aqueous metal surface treatment agent is obtained by combining a silane coupling agent (A) containing one amino group in a molecule and a silane coupling agent (B) containing one glycidyl group in a molecule at a solid content mass ratio [(A)/(B)] of 0.5 to 1.7. The combining ratio of the silane coupling agent (A) and the silane coupling agent (B) as a solid content mass ratio is necessarily in the range of 0.5 to 1.7, preferably in the range of 0.7 to 1.7, and most preferably in the range of 0.9 to 1.1. When the solid content mass ratio [(A)/(B)] is less than 0.5, fingerprint resistance, bath stability, and dreg resistance remarkably decrease, which is not preferable. On the other hand, when the solid content mass ratio [(A)/(B)] is more than 1.7, water resistance remarkably decreases, which is not preferable.

In the invention, the silane coupling agent (A) containing one amino group in a molecule is not limited particularly, but may be 3-aminopropyltriethoxysilane and 3-aminopropyltrimethoxysilane by way of example. The silane coupling agent (B) containing one glycidyl group in a molecule may be 3-glycidoxypropyltrimethoxysilane and 3-glycidoxypropyltriethoxysilane, by way of example.

A method of producing the organic silicon compound (W) is not limited particularly, but may be a method in which a silane coupling agent (A) and a silane coupling agent (B) are sequentially added to water with substantially pH 4 and are mixed for a predetermined time, by way of example.

In the organic silicon compound (W) that is an essential component of the invention, the number of functional groups (a) represented by Formula $SiR^1R^2R^3$ (where each of $R^1$, $R^2$ and $R^3$ represents an alkoxy group or a hydroxyl group independently from each other, and at least one of them represents an alkoxy group) is necessarily two or more. When the number of functional group (a) is one, adhesion to a surface of a metal material and a film forming property decrease and thus dreg resistance decreases. The number of carbon of the alkoxy group in the definition of $R^1$, $R^2$, and $R^3$ of the functional group (a) is not limited particularly, but is preferably 1 to 6, more preferably 1 to 4, and most preferably 1 or 2. According to the presumption of the inventor, the reason is that when a carbon chain of the alkoxy group is short, the number of binding per a unit area in O-M binding formed between an alkoxy group and a base metal material increases and thus adhesion between a film and a metal sheet increases. The number of at least one kind of hydrophilic functional group (b) selected from a hydroxyl group and an amino group is preferably one or more in one molecule. An average molecular weight of the organic silicon compound (W) is necessarily in the range of 1000 to 10000, and preferably in the range of 1300 to 6000. The molecular weight herein is not limited particularly, but is preferably obtained by any one of direct measurement using a TOF-MS method and conversion measurement using a chromatography method. When the average molecular weight is less than 1000, water resistance of the formed film remarkably decreases. On the other hand, when the average molecular weight is more than 10000, it is difficult to stably melt or disperse the organic silicon compound.

In a combined amount of the fluorine compound (X) that is an essential component of the invention, a solid content mass ratio [(X)/(W)] of the organic silicon compound (W) and the fluorine compound (X) is necessarily in the range of 0.02 to 0.07, preferably in the range of 0.03 to 0.06, and most preferably in the range of 0.04 to 0.05. When the solid content mass ratio [(X)/(W)] of the organic silicon compound (W) and the fluorine compound (X) is less than 0.02, the addition effect (improvement of corrosion resistance) of the fluorine compound does not appear, which is not preferable. On the other hand, when the solid content mass ratio [(X)/(W)] is more than 0.07, performance of processing or performance of application appearance deteriorates, which is not preferable.

In a combined amount of the phosphoric acid (Y) that is an essential component of the invention, a solid content mass ratio [(Y)/(W)] of the organic silicon compound (W) and the phosphoric acid (Y) is necessarily in the range of 0.03 to 0.12, preferably in the range of 0.05 to 0.12, and most preferably in the range of 0.09 to 0.1. When the solid content mass ratio [(Y)/(W)] of the organic silicon compound (W) and the phosphoric acid (Y) is less than 0.03, the addition effect (improvement of corrosion resistance) of the phosphoric acid does not appear, which is not preferable. On the other hand, when the solid content mass ratio [(Y)/(W)] is more than 0.12, solubilization in water of the film becomes conspicuous, which is not preferable.

In a combined amount of the vanadium compound (Z) that is an essential component of the invention, a solid content mass ratio [(Z)/(W)] of the organic silicon compound (W) and the vanadium compound (Z) is necessarily in the range of 0.05 to 0.17, preferably in the range of 0.09 to 0.14, and most preferably in the range of 0.11 to 0.13. When the solid content mass ratio [(Z)/(W)] of the organic silicon compound (W) and the vanadium compound (Z) is less than 0.05, the addition effect (corrosion resistance) of the vanadium compound (Z) does not appear, which is not preferable. On the other hand, when the solid content mass ratio [(Z)/(W)] is more than 0.17, bath stability remarkably decreases, which is not preferable.

The vanadium compound (Z) of the invention is not limited particularly, but may be vanadium pentoxide $V_2O_5$, metavanadic acid $HVO_3$, ammonium metavanadate, sodium metavanadate, vanadium oxytrichloride $VOCl_3$, vanadium trioxide $V_2O_3$, vanadium dioxide $VO_2$, vanadium oxysulphate $VOSO_4$, vanadium oxyacetylacetonato $VO(OC(=CH_2)CH_2COCH_3))_2$, vanadium acetylacetonato $V(OC(=CH_2)CH_2COCH_3))_3$, vanadium trichloride $VCl_3$, phosphovanadium molybdate, and the like, by way of example. In addition, pentavalent vanadium compound may be reduced into bivalent to tetravalent compounds by an organic compound having one kind of functional group selected from the group consisting of a hydroxyl group, a carbonyl group, a carboxyl group, primary to tertiary amino groups, a amide group, a phosphoric acid group, and a phosphoric acid group.

In combined amounts of the fluorine compound (X) and the vanadium compound (Z) that are essential components of the invention, a solid content mass ratio [(Z)/(X)] of the fluorine compound (X) and the vanadium compound (Z) is necessarily in the range of 1.3 to 6.0, preferably in the range of 2.5 to 3.3, and most preferably in the range of 2.8 and 3.0. When the solid content mass ratio [(Z)/(X)] of the fluorine compound (X) and the vanadium compound (Z) is less than 1.3, the addition effect of the vanadium compound (Z) does not appear, which is not preferable. On the other hand, when the solid content mass ratio [(Z)/(X)] is more than 6.0, bath stability decreases, which is not preferable.

The lubricant (J) that is an essential component of the invention is necessarily one kind selected from the group consisting of water dispersible polyethylene wax, polypropylene wax, and polytetrafluoroethylene, and preferably polyethylene wax. The water dispersible lubricant such as polyethylene wax is added to a water solution to be uniformly dispersed, which is effective. Further, one or more kinds may be added to improve dreg resistance caused by lubrication. A number average particle size of the lubricant (J) is necessarily in the range of 0.01 μm to 1.0 μm, and preferably in the range 0.05 μm to 0.5 μm. The measurement of the number average particle size herein is not limited particularly, but any one of a laser diffractive granularity distribution system and a dynamic light scattering granularity distribution system may be used. When the number average particle size of the lubricant (J) is less than 0.01 μm, the effect of lubricant does not appear, which is not preferable. When the number average particle size is more than 1.0 μm, it is easy to remain as dregs at the time of forming and the dreg resistance decreases, which is not preferable.

A softening temperature of the lubricant (J) is necessarily more than 100° C., and preferably more than 110° C. The softening temperature herein is not limited particularly, but the softening temperature may be measured using any one of a direct observation method and a light transmittance method.

When the softening temperature is less than 100° C., the lubricant is softened due to heat at the time of forming so that dregs easily occur (decrease in dreg resistance), which is not preferable.

In a combined amount of the lubricant (J) that is an essential component of the invention and the components (W+X+Y+Z) except the lubricant (J), a solid content mass ratio [(J)/(W+X+Y+Z)] of the lubricant (J) and the components (W+X+Y+Z) except the lubricant (J) is necessarily in the range of 0.02 to 0.12, preferably in the range of 0.03 to 0.12, and most preferably in the range of 0.04 to 0.12. When the solid content mass ratio [(J)/(W+X+Y+Z)] of the lubricant (J) and the components (W+X+Y+Z) except the lubricant (J) is less than 0.02, a sliding mobility and damage resistance at the time of forming decrease, which is not preferable. On the other hand, when the solid content mass ratio [(J)/(W+X+Y+Z)] is more than 0.12, a paintability decreases, which is not preferable.

The cobalt compound (C) that is an addition component of the invention is preferably at least one cobalt compound selected from the group consisting o cobalt sulfate, cobalt nitrate, and cobalt carbonate. In a combined ratio thereof, a solid content mass ratio [(C)/(W)] of the organic silicon compound (W) and the cobalt compound (C) is preferably in the range of 0.01 to 0.1, more preferably in the range of 0.02 to 0.07, and most preferably in the range of 0.03 to 0.05. When the solid content mass ratio [(C)/(W)] of the organic silicon compound (W) and the cobalt compound (C) is less than 0.01, the addition effect of the cobalt compound (C) does not appear, that is, the effect of stabilizing initial corrosion products (basic zinc chloride) of zinc to suppress corrosion as corrosion barrier does not appears, which is not preferable. On the other hand, when the solid content mass ratio [(C)/(W)] is more than 0.1, corrosion resistance decreases, which is not preferable.

In the method of producing the surface-treated metal material of the invention, it is preferable to apply the aqueous metal surface treatment agent and to dry the aqueous metal surface treatment agent at an arrival temperature more than 50° C. and less than 250° C., so that a film weight is in the range f 0.05 $g/m^2$ to 2.0 $g/m^2$. The drying temperature is preferably in the range of more than 50° C. and less than 250° C., more preferably in the range of 70° C. to 150° C., and most preferably in the range of 100° C. to 140° C. When the arrival temperature is 50° C. or less, the solvent of the aqueous metal surface treatment agent is not completely volatilized, which is not preferable. On the other hand, the arrival temperature is 250° C. or more, a part of the organic chains of the film formed by the aqueous metal surface treatment agent are decomposed, which is not preferable. A weight of the film is preferably in the range of 0.05 $g/m^2$ to 2.0 $g/m^2$, more preferably in the range of 0.2 $g/m^2$ to 1.0 $g/m^2$, and most preferably in the range of 0.3 $g/m^2$ to 0.6 $g/m^2$. When the weight of the film is less than 0.05 $g/m^2$, corrosion resistance remarkably decreases not to be able to coat the metal material surface, which is not preferably. On the other hand, when the weight of the film is more than 2.0 $g/m^2$, dreg resistance decreases, which is not preferable.

The aqueous metal surface treatment agent used in the invention may be a leveling agent, a water soluble solvent, a metal stabilizing agent, an etching restraining agent, and a pH control agent, to improve a coating property, in the scope where the effects of the invention are not spoiled. The leveling agent may be a polyethyleneoxide or polypropyleneoxide adduct, an acetyleneglycol compound, or the like, as nonionic or cationic surfactant, by way of example. The water soluble solvent may be alcohols such as ethanol, isopropylalcohol, t-butylalcohol, and propyleneglycol; cellosolves such as ethyleneglycolmonobutylether and ethyleneglycolmonoethylether; esters such as nitric ethyl and nitric butyl; and ketones such as acetone, methylethylketone, and methylisobutylketone, by way of example. The metal stabilizing agent may be chelate compounds such as EDTA and DTPA, by way of example. The etching restraining agent may be amine compounds such as ethylenediamine, triethylenepentaamine, guanidine, and pyrimidine, by way of example. Particularly, when one molecule has two or more amino groups, there is an effect as a metal stabilizing agent, which is more preferable. The pH control agent may be organic acids such as a nitric acid and a lactic acid; inorganic acids such as a hydrofluoric acid; ammonium salts; and amines.

The surface-treated metal material of the invention can satisfy all of corrosion resistance, heat resistance, solvent resistance, a paintability, a sliding mobility, damage resistance at the time of forming, and dreg resistance. The reason is presumed as follow, but the invention is not bound by the following presumption. The film formed using the aqueous metal surface treatment agent used in the invention is based mainly on organic silicon compounds. First of all, it is presumed that corrosion resistance is represented on the basis of (1) when a part of the organic silicon compounds are concentrated by drying or the like, the organic silicon compounds react with each other to form a continuous film and (2) —OR group generated by hydrolyzing a part of the organic silicon compounds forms Si—O-M binding (M: a metallic element of a coated surface) with a metal surface to represent a remarkable barrier effect. In addition, since it is possible to form a dense film, the film can be thin.

Meanwhile, the film using the aqueous metal surface treatment agent is formed on the basis of silicon, and in construction thereof the arrangement of silicon-organic chain is regular and the organic chain is relatively short. Accordingly, a silicon containing portion and an organic portion, that is, an inorganic matter and an organic matter are regularly and densely arranged in a very small area of the film. For this reason, it is presumed that it possible to a new film having all of heat resistance, conductivity, and black-dreg resistance at the time of forming in a general inorganic film; and fingerprint resistance and a paintability in a general organic film. In the silicon containing portion of the film, it is confirmed that silicon of about 80% forms siloxane binding, by analysis.

It is presumed that since a fluorine compound forming a dense film according to increase in pH due to the etching reaction in the vicinity of polarity of the surface of metal, a phosphoric acid as an effluent inhibitor, and a vanadium compound for applying corrosion resistance according to oxidation and reduction reactions are applied to apply corrosion resistance to such a base film, excellent corrosion resistance appears in addition to heat resistance, fingerprint resistance, a paintability, and dreg resistance at the time of forming. In addition, it is presumed that since the lubricant is applied to disperse the lubricant in the film without breaking the regular arrangement of the silicon-organic chain so that the lubricant uniformly exists on the surface, a performance balance such as excellent corrosion resistance appears in addition to a sliding mobility, damage resistance at the time of forming, and dreg resistance.

EXAMPLE

Hereinafter, the invention will be described in detail by way of examples of the invention and comparative examples, but the invention is not limited thereto. Production of test sheets, examples, comparative examples, and methods of applying metal material surface treatment agent will be described below.

[Production of Test Sheet]

(1) Test Material

The following commercially available material was used as a metal material.

Electrolytic zinc plated steel sheet (EG)

Sheet thickness=0.8 mm, weight per unit area=20/20 ($g/m^2$)

Molten zinc plated steel sheet (GI)

Sheet thickness=0.8 mm, weight per unit area=90/90 ($g/m^2$)

Electrolytic zinc—12% nickel plated sheet (ZL)

Sheet thickness=0.8 mm, weight per unit area=20/20 ($g/m^2$)

Alloyed molten zinc plated steel sheet (GA)

Sheet thickness=0.8 mm, weight per unit area=60/60 ($g/m^2$)

Molten zinc—11% aluminum—3% magnesium—0.2% silicon plated steel sheet (SD)

Sheet thickness=0.8 mm, weight per unit area=60/60 ($g/m^2$)

Molten zinc—55% aluminum plated steel sheet (GL)

Sheet thickness=0.8 mm, weight per unit area=60/60 ($g/m^2$)

(2) Degreasing Treatment

The test material was processed by spraying FINE CLEANER 4336 (Trademark: Nihon Parkerizing Co., Ltd.) that is a silicate based alkali degreaser, under the condition of concentration of 20 g/L and temperature of 60° C., for 2 minutes, and then the test material was cleaned by pure water for 30 seconds and was dried, thereby obtaining a test sheet.

(3) Preparation of Surface Treatment Agent

A silane coupling agent (A) and a silane coupling agent (B) were added and mixed to produce an organic silicon compound (W), and then a fluorine compound (X), a phosphoric acid (Y), a vanadium compound (Z), and a lubricant (J) were added in order and sufficiently mixed at a normal temperature, thereby preparing a surface treatment agent.

(4) Production of Surface-Treated Metal Material (Applying Method of Surface Treatment Agent)

The surface treatment agent was applied to the test sheet by a roll coater, a baking was performed while changing an arrival temperature of the sheet, and an air cooling was performed, thereby producing a surface-treated metal material.

The silane coupling agent used in Examples and Comparative Examples is shown Table 1, the vanadium compound is shown in Table 2, the lubricant is shown in Table 3, and combining examples, film amounts, and drying temperatures are shown in Tables 4 to 6.

[Evaluating Test]

1. Test of SST Planar Section

A salt spray test according to JIS-Z-2371 was performed for 120 hours, and occurrence of white rust was observed in a planar section and a processed section of the surface-treated metal material, thereby evaluating corrosion resistance of the surface-treated metal material.

<Evaluation Criteria>

VG=occurrence of rust is less than 3% of total area

G=occurrence of rust is 3% or more and less than 10% of total area

NG=occurrence of rust is 10% or more and less than 30% of total area

B=occurrence of rust is 30% or more of total area

2. Test of SST Processed Section

After an erichsen test (7 mm extrusion) was performed, a salt spray test according to JIS-Z-2371 was performed for 72 hours and occurrence of white rust was observed, thereby evaluating corrosion resistance of the processed section of the surface-treated metal material.

<Evaluation Criteria>

VG=occurrence of rust is less than 10% of total area

G=occurrence of rust is 10% or more and less than 20% of total area

NG=occurrence of rust is 20% or more and less than 30% of total area

B=occurrence of rust is 30% or more of total area

3. Test of Heat Resistance

After the surface-treated metal material was heated in an oven at 200° C. for 2 hours, a salt spray test according to the planar section corrosion resistance JIS-Z-2371 was performed for 48 hours and occurrence of white rust was observed, thereby evaluating heat resistance of the surface-treated metal material.

<Evaluation Criteria>

VG=occurrence of rust is less than 3% of total area

G=occurrence of rust is 3% or more and less than 10% of total area

NG=occurrence of rust is 10% or more and less than 30% of total area

B=occurrence of rust is 30% or more of total area

4. Test of Fingerprint Resistance

This test is to measure increase and decrease ($\Delta L$) in an L value before and after applying Vaseline using a colorimeter, thereby evaluating fingerprint resistance of the surface-treated metal material. The $\Delta L$ value represents difference in the L value before and after the test when brightness from black (0) to white (100) is represented by the L value. Specifically, the $\Delta L$ can be measured using a chroma calorimeter CR-300 (manufactured by Minolta).

<Evaluation Criteria>

VG=$\Delta L$ is less than 0.5

G=$\Delta L$ is 0.5 or more and less than 1.0

NG=$\Delta L$ is 1.0 or more and less than 2.0

B=$\Delta L$ is 2.0 or more

5. Test of Solvent Resistance

The surface-treated metal material was rubbed fifty times using a gauze with solvent infiltrated thereinto, elution of the film was confirmed by measuring Si on the basis of fluorescent X-ray analysis, thereby evaluating solvent resistance of the surface-treated metal material.

Acetone, methylethylketone, ethanol, and white gasoline were used as the solvent.

<Evaluation Criteria>

VG=ratio of elution is less than 1%

G=ratio of elution is 1% or more and less than 5%

NG=ratio of elution is 5% or more and less than 10%

B=ratio of elution is 10% or more

6. Test of Paintability

Melamine alkyd based paint was applied using a bar coat so that a thickness of the film after baking and drying is 25 μm, a baking was performed at 120° C. for 20 minutes, a cutting was performed on 1 mm check scale, and adhesion was evaluated at a remaining number ratio (remaining number/cutting number (=100)), thereby evaluating a paintability of the surface-treated metal material.

<Evaluation Criteria>

VG=100%

G=95% or more

NG=90 or more and less than 95%

B=less than 90%

7. Test of Sliding Mobility

A pullout was performed using a bead pullout tester under a load of 0.3 ton, thereby evaluating a sliding mobility of the surface-treated metal material on the basis of sliding mobility resistance (μ)

<Evaluation Criteria>

VG=μ is less than 0.30

G=μ is 0.30 or more and less than 0.35

NG=μ is 0.35 or more and less than 0.40

B=μ is 0.40 or more

8. Test of Damage Resistance at the Time of Forming

A pullout was performed using a bead pullout tester under a load of 0.3 ton, degree of damage, that is, damage resistance at the time of forming in the surface treatment agent was evaluated on the basis of increase and decrease in a ΔL value before and after the test. As described above; the ΔL value represents difference in the L value before and after the test when brightness from black (0) to white (100) is represented by the L value. Specifically, the ΔL can be measured using a chroma calorimeter CR-300 (manufactured by Minolta).

<Evaluation Criteria>

VG=ΔL is less than 0.5

G=ΔL is 0.5 or more and less than 1.0

NG=ΔL is 1.0 or more and less than 2.0

B=ΔL is 2.0 or more

9. Test of Dreg Resistance

In a high-speed deep drawability test, the surface treatment agent was processed at a drawing ratio of 2.0, generated dregs were removed by using hydrocarbons solvent in a degreasing manner, and an amount of generated dregs was measured on the basis of increase and decrease in weight before and after the test, thereby evaluating dreg resistance of the surface treatment agent.

<Evaluation Criteria>

VG=decrease in weight is less than 0.05 g/m$^2$

G=decrease in weight is 0.05 g/m$^2$ or more and less than 0.1 g/m$^2$

NG=decrease in weight is 0.1 g/m$^2$ or more and less than 0.5 g/m$^2$

B=decrease in weight is 0.5 g/m$^2$ or more

The results of the test are shown in Tables 7 to 24. It can be seen that Examples 1 to 68 in Tables 4 and 5 represent the same corrosion resistance as chromate, and satisfy all of good corrosion resistance, heat resistance, fingerprint resistance, solvent resistance, a paintability, a sliding mobility, damage resistance at the time of forming, and dreg resistance.

TABLE 1

| Silane Coupling Agent | |
|---|---|
| A1 | 3-Aminopropyltrimethoxysilane |
| A2 | 3-Aminopropyltriethoxysilane |
| B1 | 3-Glycidoxypropyltrimethoxysilane |
| B2 | 3-Glycidoxypropyltriethoxysilane |

TABLE 2

| V Compound | |
|---|---|
| Z1 | Vanadium oxysulphate |
| Z2 | Vanadium dioxide |
| Z3 | Vanadium oxyacetylacetate |
| Z4 | Vanadium acetylacetate |

TABLE 3

| Lubricant | |
|---|---|
| D1 | Polyethylene wax |
| D2 | Polypropylene wax |
| D3 | Polytetrafluoroethylene |
| D4 | Paraffin wax |

TABLE 4

| | Organic Silicon Compound (W) | | | | | | Fluorine Compound (X) | | Phosphoric Acid (Y) | Vanadium Compound (Z) | | |
|---|---|---|---|---|---|---|---|---|---|---|---|---|
| | Silane Coupling Agent | | Ratio | Functional Group Number | Functional Group Number | Molecular | | Ratio | Ratio | | Ratio | |
| | (A) | (B) | (A)/(B) | of (a) | of (b) | Weight | Type | (X)/(W) | (Y)/(W) | Type | (Z)/(W) | (Z)/(X) |
| Ex. 1 | A1 | B1 | 0.5 | 2 | 2 | 1500 | Zr | 0.03 | 0.05 | Z1 | 0.07 | 2.3 |
| Ex. 2 | A1 | B1 | 0.7 | 2 | 1 | 1500 | Zr | 0.03 | 0.06 | Z1 | 0.07 | 2.3 |
| Ex. 3 | A1 | B1 | 1.0 | 2 | 1 | 1500 | Zr | 0.03 | 0.06 | Z1 | 0.07 | 2.3 |
| Ex. 4 | A1 | B1 | 1.2 | 2 | 1 | 1500 | Zr | 0.03 | 0.06 | Z1 | 0.07 | 2.3 |
| Ex. 5 | A1 | B1 | 1.5 | 2 | 1 | 1500 | Zr | 0.03 | 0.06 | Z1 | 0.07 | 2.3 |
| Ex. 6 | A1 | B1 | 1.7 | 2 | 1 | 1500 | Zr | 0.03 | 0.06 | Z1 | 0.07 | 2.3 |
| Ex. 7 | A1 | B2 | 1.0 | 2 | 3 | 1500 | Zr | 0.03 | 0.06 | Z1 | 0.07 | 2.3 |
| Ex. 8 | A1 | B1 | 1.0 | 3 | 1 | 1500 | Zr | 0.03 | 0.06 | Z1 | 0.07 | 2.3 |
| Ex. 9 | A1 | B1 | 1.0 | 2 | 1 | 1000 | Zr | 0.03 | 0.06 | Z1 | 0.07 | 2.3 |
| Ex. 10 | A1 | B1 | 1.0 | 2 | 1 | 2000 | Zr | 0.03 | 0.06 | Z1 | 0.07 | 2.3 |
| Ex. 11 | A1 | B1 | 1.0 | 2 | 1 | 4000 | Zr | 0.03 | 0.06 | Z1 | 0.07 | 2.3 |
| Ex. 12 | A1 | B1 | 1.0 | 2 | 1 | 8000 | Zr | 0.03 | 0.06 | Z1 | 0.07 | 2.3 |
| Ex. 13 | A1 | B1 | 1.0 | 2 | 1 | 10000 | Zr | 0.03 | 0.06 | Z1 | 0.07 | 2.3 |
| Ex. 14 | A1 | B1 | 1.0 | 2 | 1 | 3000 | Zr | 0.02 | 0.06 | Z1 | 0.05 | 2.5 |
| Ex. 15 | A1 | B1 | 1.0 | 2 | 1 | 3000 | Zr | 0.05 | 0.06 | Z1 | 0.12 | 2.4 |
| Ex. 16 | A1 | B1 | 1.0 | 2 | 1 | 3000 | Zr | 0.07 | 0.06 | Z1 | 0.16 | 2.3 |
| Ex. 17 | A1 | B1 | 1.0 | 2 | 1 | 3000 | Ti | 0.02 | 0.06 | Z1 | 0.05 | 2.5 |
| Ex. 18 | A1 | B1 | 1.0 | 2 | 1 | 3000 | Ti | 0.05 | 0.06 | Z1 | 0.12 | 2.4 |
| Ex. 19 | A1 | B1 | 1.0 | 2 | 1 | 3000 | Ti | 0.07 | 0.06 | Z1 | 0.16 | 2.3 |
| Ex. 20 | A2 | B1 | 1.0 | 2 | 1 | 3000 | Ti | 0.05 | 0.03 | Z1 | 0.07 | 1.4 |
| Ex. 21 | A2 | B1 | 1.0 | 2 | 1 | 3000 | Ti | 0.05 | 0.05 | Z1 | 0.07 | 1.4 |
| Ex. 22 | A2 | B1 | 1.0 | 2 | 1 | 3000 | Ti | 0.05 | 0.07 | Z1 | 0.07 | 1.4 |
| Ex. 23 | A2 | B1 | 1.0 | 2 | 1 | 3000 | Ti | 0.05 | 0.1 | Z1 | 0.07 | 1.4 |
| Ex. 24 | A2 | B1 | 1.0 | 2 | 1 | 3000 | Ti | 0.05 | 0.12 | Z1 | 0.07 | 1.4 |

TABLE 4-continued

| | | | | | | | | | | | | |
|---|---|---|---|---|---|---|---|---|---|---|---|---|
| Ex. 25 | A2 | B2 | 1.0 | 2 | 1 | 3000 | Ti | 0.05 | 0.07 | Z1 | 0.07 | 1.4 |
| Ex. 26 | A2 | B1 | 1.0 | 2 | 1 | 3000 | Ti | 0.06 | 0.07 | Z1 | 0.08 | 1.3 |
| Ex. 27 | A2 | B1 | 1.0 | 2 | 1 | 3000 | Ti | 0.05 | 0.07 | Z1 | 0.10 | 2.0 |
| Ex. 28 | A2 | B1 | 1.0 | 2 | 1 | 3000 | Ti | 0.05 | 0.07 | Z1 | 0.13 | 2.6 |
| Ex. 29 | A2 | B1 | 1.0 | 2 | 1 | 3000 | Ti | 0.05 | 0.07 | Z1 | 0.15 | 3.0 |
| Ex. 30 | A2 | B1 | 1.0 | 2 | 1 | 3000 | Ti | 0.05 | 0.07 | Z1 | 0.17 | 3.4 |
| Ex. 31 | A2 | B1 | 1.0 | 2 | 1 | 3000 | Ti | 0.03 | 0.07 | Z1 | 0.15 | 5.0 |
| Ex. 32 | A2 | B1 | 1.0 | 2 | 1 | 3000 | Ti | 0.02 | 0.07 | Z1 | 0.12 | 6.0 |
| Ex. 33 | A2 | B1 | 1.0 | 2 | 1 | 3000 | Ti | 0.05 | 0.07 | Z2 | 0.07 | 1.4 |
| Ex. 34 | A2 | B1 | 1.0 | 2 | 1 | 3000 | Ti | 0.05 | 0.07 | Z2 | 0.10 | 2.0 |

| | Lubricant (J) | | | | Film | Drying | Co Compound |
|---|---|---|---|---|---|---|---|
| | Type | Particle Size | Softening Point | Ratio (J)/(W + X + Y + Z) | Amount g/m$^2$ | Temperature ° C. | (C) (C)/(W) |
| Ex. 1 | D1 | 0.10 | 100 | 0.05 | 0.35 | 120° C. | — |
| Ex. 2 | D1 | 0.10 | 100 | 0.05 | 0.35 | 120° C. | — |
| Ex. 3 | D1 | 0.10 | 100 | 0.05 | 0.35 | 120° C. | — |
| Ex. 4 | D1 | 0.10 | 100 | 0.05 | 0.35 | 120° C. | — |
| Ex. 5 | D1 | 0.10 | 100 | 0.05 | 0.35 | 120° C. | — |
| Ex. 6 | D1 | 0.10 | 100 | 0.02 | 0.35 | 120° C. | — |
| Ex. 7 | D1 | 0.10 | 100 | 0.05 | 0.35 | 120° C. | — |
| Ex. 8 | D1 | 0.10 | 100 | 0.10 | 0.35 | 120° C. | — |
| Ex. 9 | D1 | 0.10 | 100 | 0.05 | 0.35 | 120° C. | — |
| Ex. 10 | D1 | 0.10 | 100 | 0.05 | 0.35 | 120° C. | — |
| Ex. 11 | D2 | 0.10 | 120 | 0.05 | 0.35 | 120° C. | — |
| Ex. 12 | D3 | 0.10 | 320 | 0.05 | 0.35 | 120° C. | — |
| Ex. 13 | D1 | 0.10 | 100 | 0.05 | 0.35 | 120° C. | — |
| Ex. 14 | D1 | 0.10 | 100 | 0.05 | 0.35 | 120° C. | — |
| Ex. 15 | D1 | 0.10 | 100 | 0.05 | 0.35 | 120° C. | — |
| Ex. 16 | D1 | 0.10 | 100 | 0.05 | 0.35 | 120° C. | — |
| Ex. 17 | D1 | 0.10 | 100 | 0.05 | 0.35 | 120° C. | — |
| Ex. 18 | D1 | 0.10 | 100 | 0.05 | 0.35 | 120° C. | — |
| Ex. 19 | D1 | 0.01 | 100 | 0.05 | 0.35 | 120° C. | — |
| Ex. 20 | D1 | 0.05 | 100 | 0.05 | 0.35 | 120° C. | — |
| Ex. 21 | D1 | 0.20 | 100 | 0.02 | 0.35 | 120° C. | — |
| Ex. 22 | D1 | 0.50 | 100 | 0.05 | 0.35 | 120° C. | — |
| Ex. 23 | D1 | 0.70 | 100 | 0.10 | 0.35 | 120° C. | — |
| Ex. 24 | D1 | 1.00 | 100 | 0.05 | 0.35 | 120° C. | — |
| Ex. 25 | D1 | 0.10 | 100 | 0.05 | 0.35 | 120° C. | — |
| Ex. 26 | D1 | 0.10 | 100 | 0.05 | 0.35 | 120° C. | — |
| Ex. 27 | D2 | 0.10 | 120 | 0.05 | 0.35 | 120° C. | — |
| Ex. 28 | D3 | 0.10 | 320 | 0.05 | 0.35 | 120° C. | — |
| Ex. 29 | D1 | 0.10 | 100 | 0.05 | 0.35 | 120° C. | — |
| Ex. 30 | D1 | 0.10 | 100 | 0.05 | 0.35 | 120° C. | — |
| Ex. 31 | D1 | 0.10 | 100 | 0.05 | 0.35 | 120° C. | — |
| Ex. 32 | D1 | 0.10 | 100 | 0.05 | 0.35 | 120° C. | — |
| Ex. 33 | D1 | 0.10 | 100 | 0.05 | 0.35 | 120° C. | — |
| Ex. 34 | D1 | 0.10 | 100 | 0.05 | 0.35 | 120° C. | — |

TABLE 5

| | Organic Silicon Compound (W) | | | | | | Fluorine Compound (X) | | Phosphoric Acid (Y) | Vanadium Compound (Z) | | |
|---|---|---|---|---|---|---|---|---|---|---|---|---|
| | Silane Coupling Agent | | Ratio | Functional Group Number | Functional Group Number | Molecular | | Ratio | Ratio | | Ratio | |
| | (A) | (B) | (A)/(B) | of (a) | of (b) | Weight | Type | (X)/(W) | (Y)/(W) | Type | (Z)/(W) | (Z)/(X) |
| Ex. 35 | A2 | B1 | 1.0 | 2 | 1 | 3000 | Ti | 0.05 | 0.07 | Z2 | 0.13 | 2.6 |
| Ex. 36 | A2 | B1 | 1.0 | 2 | 1 | 3000 | Ti | 0.05 | 0.07 | Z3 | 0.07 | 1.4 |
| Ex. 37 | A2 | B1 | 1.0 | 2 | 1 | 3000 | Ti | 0.05 | 0.07 | Z3 | 0.10 | 2.0 |
| Ex. 38 | A2 | B1 | 1.0 | 2 | 1 | 3000 | Ti | 0.05 | 0.07 | Z3 | 0.13 | 2.6 |
| Ex. 39 | A2 | B1 | 1.0 | 2 | 1 | 3000 | Ti | 0.05 | 0.07 | Z4 | 0.07 | 1.4 |
| Ex. 40 | A2 | B1 | 1.0 | 2 | 1 | 3000 | Ti | 0.05 | 0.07 | Z4 | 0.10 | 2.0 |
| Ex. 41 | A2 | B1 | 1.0 | 2 | 1 | 3000 | Ti | 0.05 | 0.07 | Z4 | 0.13 | 2.6 |
| Ex. 42 | A2 | B1 | 1.0 | 2 | 1 | 3000 | Ti | 0.05 | 0.07 | Z5 | 0.07 | 1.4 |
| Ex. 43 | A2 | B1 | 1.0 | 2 | 1 | 3000 | Ti | 0.05 | 0.07 | Z5 | 0.10 | 2.0 |
| Ex. 44 | A2 | B1 | 1.0 | 2 | 1 | 3000 | Ti | 0.05 | 0.07 | Z5 | 0.13 | 2.6 |
| Ex. 45 | A2 | B1 | 1.0 | 2 | 1 | 3000 | Ti | 0.05 | 0.07 | Z1 | 0.07 | 1.4 |
| Ex. 46 | A2 | B1 | 1.0 | 2 | 1 | 3000 | Ti | 0.05 | 0.07 | Z1 | 0.07 | 1.4 |
| Ex. 47 | A2 | B1 | 1.0 | 2 | 1 | 3000 | Ti | 0.05 | 0.07 | Z1 | 0.07 | 1.4 |
| Ex. 48 | A2 | B1 | 1.0 | 2 | 1 | 3000 | Ti | 0.05 | 0.07 | Z1 | 0.07 | 1.4 |

TABLE 5-continued

| | | | | | | | | | | | | |
|---|---|---|---|---|---|---|---|---|---|---|---|---|
| Ex. 49 | A2 | B1 | 1.0 | 2 | 1 | 3000 | Ti | 0.05 | 0.07 | Z1 | 0.07 | 1.4 |
| Ex. 50 | A2 | B1 | 1.0 | 2 | 1 | 3000 | Ti | 0.05 | 0.07 | Z1 | 0.07 | 1.4 |
| Ex. 51 | A2 | B1 | 1.0 | 2 | 1 | 3000 | Ti | 0.05 | 0.07 | Z1 | 0.07 | 1.4 |
| Ex. 52 | A2 | B1 | 1.0 | 2 | 1 | 3000 | Ti | 0.05 | 0.07 | Z1 | 0.07 | 1.4 |
| Ex. 53 | A2 | B1 | 1.0 | 2 | 1 | 3000 | Ti | 0.05 | 0.07 | Z1 | 0.07 | 1.4 |
| Ex. 54 | A2 | B1 | 1.0 | 2 | 1 | 3000 | Ti | 0.05 | 0.07 | Z1 | 0.07 | 1.4 |
| Ex. 55 | A2 | B1 | 1.0 | 2 | 1 | 3000 | Ti | 0.05 | 0.07 | Z1 | 0.07 | 1.4 |
| Ex. 56 | A2 | B1 | 1.0 | 2 | 1 | 3000 | Ti | 0.05 | 0.07 | Z1 | 0.07 | 1.4 |
| Ex. 57 | A2 | B1 | 1.0 | 2 | 1 | 3000 | Ti | 0.05 | 0.07 | Z1 | 0.07 | 1.4 |
| Ex. 58 | A2 | B1 | 1.0 | 2 | 1 | 3000 | Ti | 0.05 | 0.07 | Z1 | 0.07 | 1.4 |
| Ex. 59 | A2 | B1 | 1.0 | 2 | 1 | 3000 | Ti | 0.05 | 0.07 | Z1 | 0.07 | 1.4 |
| Ex. 60 | A2 | B1 | 1.0 | 2 | 1 | 3000 | Ti | 0.05 | 0.07 | Z1 | 0.07 | 1.4 |
| Ex. 61 | A2 | B1 | 1.0 | 2 | 1 | 3000 | Ti | 0.05 | 0.07 | Z1 | 0.07 | 1.4 |
| Ex. 62 | A2 | B1 | 1.0 | 2 | 1 | 3000 | Ti | 0.05 | 0.07 | Z1 | 0.07 | 1.4 |
| Ex. 63 | A2 | B1 | 1.0 | 2 | 1 | 3000 | Ti | 0.05 | 0.07 | Z1 | 0.07 | 1.4 |
| Ex. 64 | A2 | B1 | 1.0 | 2 | 1 | 3000 | Ti | 0.05 | 0.07 | Z1 | 0.07 | 1.4 |
| Ex. 65 | A2 | B1 | 1.0 | 2 | 1 | 3000 | Ti | 0.05 | 0.07 | Z1 | 0.07 | 1.4 |
| Ex. 66 | A2 | B1 | 1.0 | 2 | 1 | 3000 | Ti | 0.05 | 0.07 | Z1 | 0.07 | 1.4 |
| Ex. 67 | A2 | B1 | 1.0 | 2 | 2 | 3000 | Ti | 0.05 | 0.07 | Z1 | 0.07 | 1.4 |
| Ex. 68 | A2 | B1 | 1.0 | 2 | 3 | 3000 | Ti | 0.05 | 0.07 | Z1 | 0.07 | 1.4 |

| | Lubricant (J) | | | | Film | Drying | Co Compound |
|---|---|---|---|---|---|---|---|
| | Type | Particle Size | Softening Point | Ratio (J)/(W + X + Y + Z) | Amount g/m$^2$ | Temperature ° C. | (C) (C)/(W) |
| Ex. 35 | D1 | 0.10 | 100 | 0.05 | 0.35 | 120° C. | — |
| Ex. 36 | D1 | 0.10 | 110 | 0.05 | 0.35 | 120° C. | — |
| Ex. 37 | D1 | 0.10 | 120 | 0.05 | 0.35 | 120° C. | — |
| Ex. 38 | D1 | 0.10 | 130 | 0.02 | 0.35 | 120° C. | — |
| Ex. 39 | D1 | 0.10 | 140 | 0.05 | 0.35 | 120° C. | — |
| Ex. 40 | D1 | 0.10 | 150 | 0.10 | 0.35 | 120° C. | — |
| Ex. 41 | D1 | 0.10 | 100 | 0.05 | 0.35 | 120° C. | — |
| Ex. 42 | D1 | 0.10 | 100 | 0.05 | 0.35 | 120° C. | — |
| Ex. 43 | D1 | 0.10 | 100 | 0.05 | 0.35 | 120° C. | — |
| Ex. 44 | D1 | 0.10 | 100 | 0.05 | 0.35 | 120° C. | — |
| Ex. 45 | D1 | 0.10 | 100 | 0.05 | 0.10 | 120° C. | — |
| Ex. 46 | D1 | 0.10 | 100 | 0.05 | 0.15 | 120° C. | — |
| Ex. 47 | D2 | 0.10 | 120 | 0.05 | 0.20 | 120° C. | — |
| Ex. 48 | D3 | 0.10 | 320 | 0.05 | 0.25 | 120° C. | — |
| Ex. 49 | D1 | 0.10 | 100 | 0.05 | 0.30 | 120° C. | — |
| Ex. 50 | D1 | 0.10 | 100 | 0.05 | 0.40 | 120° C. | — |
| Ex. 51 | D1 | 0.10 | 100 | 0.05 | 0.45 | 120° C. | — |
| Ex. 52 | D1 | 0.10 | 100 | 0.05 | 0.50 | 120° C. | — |
| Ex. 53 | D1 | 0.10 | 100 | 0.05 | 0.55 | 120° C. | 0.02 |
| Ex. 54 | D1 | 0.10 | 100 | 0.05 | 0.60 | 120° C. | 0.04 |
| Ex. 55 | D1 | 0.10 | 100 | 0.05 | 0.35 | 60° C. | 0.06 |
| Ex. 56 | D1 | 0.10 | 100 | 0.05 | 0.35 | 70° C. | — |
| Ex. 57 | D1 | 0.10 | 100 | 0.05 | 0.35 | 80° C. | — |
| Ex. 58 | D1 | 0.10 | 100 | 0.05 | 0.35 | 90° C. | — |
| Ex. 59 | D1 | 0.10 | 100 | 0.05 | 0.35 | 100° C. | — |
| Ex. 60 | D1 | 0.10 | 100 | 0.05 | 0.35 | 110° C. | — |
| Ex. 61 | D2 | 0.10 | 120 | 0.05 | 0.35 | 130° C. | — |
| Ex. 62 | D3 | 0.10 | 320 | 0.05 | 0.35 | 140° C. | — |
| Ex. 63 | D1 | 0.10 | 100 | 0.05 | 0.35 | 150° C. | — |
| Ex. 64 | D1 | 0.10 | 100 | 0.05 | 0.35 | 160° C. | — |
| Ex. 65 | D1 | 0.10 | 100 | 0.05 | 0.35 | 170° C. | — |
| Ex. 66 | D1 | 0.10 | 100 | 0.05 | 0.35 | 180° C. | — |
| Ex. 67 | D1 | 0.10 | 100 | 0.05 | 0.35 | 190° C. | — |
| Ex. 68 | D1 | 0.10 | 100 | 0.05 | 0.35 | 200° C. | — |

TABLE 6

| | Organic Silicon Compound (W) | | | | | | | | | | | |
|---|---|---|---|---|---|---|---|---|---|---|---|---|
| | Silane Coupling Agent | | Ratio | Functional Group | Functional Group | | Fluorine Compound (X) | | Phosphoric Acid (Y) | Vanadium Compound (Z) | | |
| | (A) | (B) | (A)/(B) | Number of (a) | Number of (b) | Molecular Weight | Type | Ratio (X)/(W) | Ratio (Y)/(W) | Type | Ratio (Z)/(W) | Ratio (Z)/(X) |
| Comp. 1 | A1 | — | — | 1 | 1 | 500 | Zr | 0.03 | 0.06 | Z1 | 0.07 | 2.3 |
| Comp. 2 | A1 | B1 | 0.4 | 2 | 1 | 2000 | Zr | 0.03 | 0.06 | Z1 | 0.07 | 2.3 |
| Comp. 3 | A1 | B1 | 3.0 | 2 | 1 | 3400 | Zr | 0.03 | 0.06 | Z1 | 0.07 | 2.3 |
| Comp. 4 | A1 | B1 | 1.0 | 2 | 1 | 3000 | — | — | 0.06 | Z1 | 0.07 | — |

TABLE 6-continued

| | | | | | | | | | | | | |
|---|---|---|---|---|---|---|---|---|---|---|---|---|
| Comp. 5 | A1 | B1 | 1.0 | 2 | 1 | 3000 | Zr | 0.03 | — | Z1 | 0.07 | 2.3 |
| Comp. 6 | A1 | B1 | 1.0 | 2 | 1 | 3000 | Zr | 0.03 | 0.06 | — | — | — |
| Comp. 7 | A1 | B1 | 1.0 | 2 | 1 | 3000 | Zr | 0.03 | 0.06 | Z1 | 0.07 | 2.3 |
| Comp. 8 | A1 | B1 | 1.0 | 2 | 1 | 3000 | Zr | 0.03 | 0.06 | Z1 | 0.07 | 2.3 |
| Comp. 9 | A1 | B1 | 1.0 | 2 | 0 | 3000 | Zr | 0.03 | 0.06 | Z1 | 0.07 | 2.3 |
| Comp. 10 | A1 | B1 | 1.0 | 2 | 0 | 3000 | Zr | 0.03 | 0.06 | Z1 | 0.07 | 2.3 |
| Comp. 11 | A1 | B1 | 0.7 | 2 | 0 | 1500 | Zr | 0.03 | 0.06 | Z1 | 0.07 | 2.3 |
| Comp. 12 | A1 | B1 | 1.0 | 2 | 0 | 1500 | Zr | 0.03 | 0.06 | Z1 | 0.07 | 2.3 |

| | Lubricant (J) | | | | Film | Drying | Co Compound |
|---|---|---|---|---|---|---|---|
| | Type | Particle Size | Softening Point | Ratio (J)/(W + X + Y + Z) | Amount g/m$^2$ | Temperature ° C. | (C) (C)/(W) |
| Comp. 1 | D1 | 0.1 | 100.0 | 0.01 | 0.35 | 120° C. | — |
| Comp. 2 | D1 | 0.1 | 100.0 | 0.01 | 0.35 | 120° C. | — |
| Comp. 3 | — | — | — | — | 0.35 | 120° C. | — |
| Comp. 4 | D1 | 0.1 | 100.0 | 0.15 | 0.35 | 120° C. | — |
| Comp. 5 | D3 | 0.2 | 320.0 | 0.01 | 0.35 | 120° C. | — |
| Comp. 6 | — | — | — | — | 0.35 | 120° C. | — |
| Comp. 7 | D1 | 0.1 | 100.0 | 0.02 | 0.05 | 120° C. | — |
| Comp. 8 | — | — | — | — | 2.5 | 120° C. | — |
| Comp. 9 | D1 | 0.1 | 100.0 | 0.01 | 0.35 | 50° C. | — |
| Comp. 10 | D1 | 0.1 | 100.0 | 0.0 | 0.35 | 250° C. | — |
| Comp. 11 | D4 | 0.1 | 70.0 | 0.01 | 0.35 | 120° C. | — |
| Comp. 12 | D1 | 2.0 | 100.0 | 0.01 | 0.35 | 120° C. | — |

TABLE 7

| | EG | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Ex. 1 | VG | G | VG | G | VG | VG | VG | VG | VG |
| Ex. 2 | VG | G | VG | G | VG | VG | VG | VG | VG |
| Ex. 3 | VG | VG | VG | VG | VG | VG | VG | VG | VG |
| Ex. 4 | VG | VG | VG | VG | VG | VG | VG | VG | VG |
| Ex. 5 | VG | VG | VG | VG | VG | VG | VG | VG | VG |
| Ex. 6 | VG | VG | VG | VG | VG | VG | G | VG | VG |
| Ex. 7 | VG | VG | VG | VG | VG | VG | VG | VG | VG |
| Ex. 8 | VG | VG | VG | VG | VG | VG | VG | VG | VG |
| Ex. 9 | VG | G | VG | G | VG | VG | VG | VG | VG |
| Ex. 10 | VG | G | VG | G | VG | VG | VG | VG | VG |
| Ex. 11 | VG | VG | VG | VG | VG | VG | VG | VG | G |
| Ex. 12 | VG | VG | VG | VG | VG | VG | VG | VG | VG |
| Ex. 13 | VG | VG | VG | VG | VG | VG | VG | VG | VG |
| Ex. 14 | G | G | VG | VG | VG | VG | VG | VG | VG |
| Ex. 15 | VG | VG | VG | VG | VG | VG | VG | VG | VG |
| Ex. 16 | VG | VG | VG | VG | VG | VG | VG | VG | VG |
| Ex. 17 | G | VG | VG | VG | VG | VG | VG | VG | VG |
| Ex. 18 | VG | VG | VG | VG | VG | VG | VG | VG | VG |
| Ex. 19 | VG | VG | VG | VG | VG | VG | VG | VG | VG |
| Ex. 20 | VG | VG | VG | VG | VG | VG | VG | VG | VG |
| Ex. 21 | VG | VG | VG | VG | VG | VG | VG | G | VG |
| Ex. 22 | VG | VG | VG | VG | VG | VG | VG | VG | VG |
| Ex. 23 | VG | VG | VG | G | VG | G | VG | VG | VG |
| Ex. 24 | VG | VG | VG | G | VG | G | VG | VG | VG |
| Ex. 25 | VG | VG | VG | VG | VG | VG | VG | VG | VG |
| Ex. 26 | VG | G | VG | VG | VG | VG | VG | VG | VG |
| Ex. 27 | VG | VG | VG | VG | VG | VG | VG | VG | VG |
| Ex. 28 | VG | VG | VG | VG | VG | G | VG | VG | G |
| Ex. 29 | VG | VG | G | VG | VG | G | VG | VG | VG |
| Ex. 30 | VG | VG | G | VG | VG | G | VG | VG | VG |
| Ex. 31 | G | G | G | VG | VG | G | VG | VG | VG |
| Ex. 32 | G | G | G | VG | VG | G | VG | VG | VG |
| Ex. 33 | G | G | G | VG | VG | VG | VG | VG | VG |
| Ex. 34 | G | G | G | VG | VG | VG | VG | VG | VG |

TABLE 8

| | EG | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Ex. 35 | G | G | G | VG | VG | VG | VG | VG | VG |
| Ex. 36 | VG | G | G | VG | VG | VG | VG | VG | VG |
| Ex. 37 | VG | G | G | VG | VG | VG | VG | VG | VG |
| Ex. 38 | VG | G | G | VG | VG | G | G | VG | VG |
| Ex. 39 | VG | VG | VG | VG | VG | VG | VG | VG | VG |
| Ex. 40 | VG | VG | VG | VG | VG | VG | VG | VG | VG |
| Ex. 41 | VG | VG | VG | VG | VG | VG | VG | VG | VG |
| Ex. 42 | VG | G | VG | VG | VG | VG | VG | VG | VG |
| Ex. 43 | VG | G | VG | VG | VG | VG | VG | VG | VG |
| Ex. 44 | VG | G | VG | VG | VG | VG | VG | VG | VG |
| Ex. 45 | G | G | G | G | VG | VG | VG | VG | VG |
| Ex. 46 | G | G | G | G | VG | VG | VG | VG | VG |
| Ex. 47 | G | VG | G | G | VG | VG | VG | VG | VG |
| Ex. 48 | VG | VG | VG | G | VG | VG | VG | VG | G |
| Ex. 49 | VG | VG | VG | VG | G | VG | VG | VG | VG |
| Ex. 50 | VG | VG | VG | VG | G | VG | VG | VG | VG |
| Ex. 51 | VG | VG | VG | VG | VG | VG | VG | VG | VG |
| Ex. 52 | VG | VG | VG | VG | VG | VG | VG | VG | VG |
| Ex. 53 | VG | G | VG | VG | VG | VG | VG | VG | VG |
| Ex. 54 | VG | G | VG | VG | VG | VG | VG | VG | VG |
| Ex. 55 | VG | G | VG | G | VG | G | VG | VG | VG |
| Ex. 56 | VG | VG | VG | G | VG | G | VG | VG | VG |
| Ex. 57 | VG | VG | VG | VG | VG | G | VG | VG | VG |
| Ex. 58 | VG | VG | VG | VG | VG | G | VG | VG | VG |
| Ex. 59 | VG | VG | VG | VG | VG | G | VG | VG | VG |
| Ex. 60 | VG | VG | VG | VG | VG | VG | VG | VG | VG |
| Ex. 61 | VG | VG | VG | VG | VG | VG | VG | VG | VG |
| Ex. 62 | VG | VG | VG | VG | VG | VG | VG | VG | VG |
| Ex. 63 | VG | G | VG | VG | VG | VG | VG | VG | VG |
| Ex. 64 | VG | G | VG | VG | VG | VG | VG | VG | VG |
| Ex. 65 | VG | G | VG | VG | VG | VG | VG | VG | VG |
| Ex. 66 | VG | G | VG | VG | VG | VG | VG | VG | VG |
| Ex. 67 | VG | G | VG | G | VG | VG | VG | VG | VG |
| Ex. 68 | VG | G | VG | G | VG | VG | VG | VG | VG |

TABLE 9

| | EG | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Comp. 1 | B | B | B | B | G | B | NG | NG | G |
| Comp. 2 | VG | VG | VG | B | VG | VG | NG | NG | B |
| Comp. 3 | NG | NG | G | VG | VG | NG | B | B | B |
| Comp. 4 | B | B | B | VG | VG | VG | NG | NG | NG |
| Comp. 5 | NG | B | B | VG | VG | VG | NG | NG | G |
| Comp. 6 | NG | B | B | VG | VG | VG | B | B | B |
| Comp. 7 | B | B | B | B | VG | G | NG | NG | G |
| Comp. 8 | VG | G | VG | VG | B | G | B | B | B |
| Comp. 9 | B | B | NG | NG | VG | NG | NG | NG | B |
| Comp. 10 | NG | B | NG | B | VG | VG | NG | NG | B |
| Comp. 11 | VG | VG | VG | VG | VG | VG | B | B | B |
| Comp. 12 | VG | VG | VG | VG | VG | VG | NG | NG | B |

TABLE 10

| | GI | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Ex. 1 | VG | G | VG | G | VG | VG | VG | VG | VG |
| Ex. 2 | VG | G | VG | G | VG | VG | VG | VG | VG |
| Ex. 3 | VG | VG | VG | VG | VG | VG | VG | VG | VG |
| Ex. 4 | VG | VG | VG | VG | VG | VG | VG | VG | VG |
| Ex. 5 | VG | VG | VG | VG | VG | VG | VG | VG | VG |
| Ex. 6 | VG | VG | VG | VG | VG | VG | G | VG | VG |
| Ex. 7 | VG | VG | VG | VG | VG | VG | VG | VG | VG |
| Ex. 8 | VG | VG | VG | VG | VG | VG | VG | VG | VG |
| Ex. 9 | VG | G | VG | G | VG | VG | VG | VG | VG |
| Ex. 10 | VG | G | VG | G | VG | VG | VG | VG | VG |
| Ex. 11 | VG | VG | VG | VG | VG | VG | VG | VG | G |
| Ex. 12 | VG | VG | VG | VG | VG | VG | VG | VG | VG |
| Ex. 13 | VG | VG | VG | VG | VG | VG | VG | VG | VG |
| Ex. 14 | VG | G | VG | VG | VG | VG | VG | VG | VG |
| Ex. 15 | VG | VG | VG | VG | VG | VG | VG | VG | VG |
| Ex. 16 | VG | VG | VG | VG | VG | VG | VG | VG | VG |
| Ex. 17 | VG | VG | VG | VG | VG | VG | VG | VG | VG |
| Ex. 18 | VG | VG | VG | VG | VG | VG | VG | VG | VG |
| Ex. 19 | VG | VG | VG | VG | VG | VG | VG | VG | VG |
| Ex. 20 | VG | VG | VG | VG | VG | VG | VG | VG | VG |
| Ex. 21 | VG | VG | VG | VG | VG | VG | VG | G | VG |
| Ex. 22 | VG | VG | VG | VG | VG | VG | VG | VG | VG |
| Ex. 23 | VG | VG | VG | G | VG | G | VG | VG | VG |
| Ex. 24 | VG | VG | VG | G | VG | G | VG | VG | VG |
| Ex. 25 | VG | VG | VG | VG | VG | VG | VG | VG | VG |
| Ex. 26 | VG | G | VG | VG | VG | VG | VG | VG | VG |
| Ex. 27 | VG | VG | VG | VG | VG | VG | VG | VG | VG |
| Ex. 28 | VG | VG | VG | VG | VG | G | VG | VG | G |
| Ex. 29 | VG | VG | G | VG | VG | G | VG | VG | VG |
| Ex. 30 | VG | VG | G | VG | VG | G | VG | VG | VG |
| Ex. 31 | G | G | G | VG | VG | G | VG | VG | VG |
| Ex. 32 | G | G | G | VG | VG | G | VG | VG | VG |
| Ex. 33 | VG | G | G | VG | VG | VG | VG | VG | VG |
| Ex. 34 | VG | G | G | VG | VG | VG | VG | VG | VG |

TABLE 11

| | GI | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Ex. 35 | VG | G | G | VG | VG | VG | VG | VG | VG |
| Ex. 36 | VG | G | G | VG | VG | VG | VG | VG | VG |
| Ex. 37 | VG | G | G | VG | VG | VG | VG | VG | VG |
| Ex. 38 | VG | G | G | VG | VG | G | G | VG | VG |
| Ex. 39 | VG | VG | VG | VG | VG | VG | VG | VG | VG |
| Ex. 40 | VG | VG | VG | VG | VG | VG | VG | VG | VG |
| Ex. 41 | VG | VG | VG | VG | VG | VG | VG | VG | VG |
| Ex. 42 | VG | G | VG | VG | VG | VG | VG | VG | VG |
| Ex. 43 | VG | G | VG | VG | VG | VG | VG | VG | VG |
| Ex. 44 | VG | G | VG | VG | VG | VG | VG | VG | VG |
| Ex. 45 | G | G | G | G | VG | VG | VG | VG | VG |
| Ex. 46 | G | G | G | G | VG | VG | VG | VG | VG |
| Ex. 47 | VG | VG | G | G | G | VG | VG | VG | VG |
| Ex. 48 | VG | VG | VG | G | G | VG | VG | VG | VG |
| Ex. 49 | VG | VG | VG | VG | G | VG | VG | VG | VG |
| Ex. 50 | VG | VG | VG | VG | G | VG | VG | VG | G |
| Ex. 51 | VG | VG | VG | VG | VG | VG | VG | VG | G |
| Ex. 52 | VG | VG | VG | VG | VG | VG | VG | VG | G |
| Ex. 53 | VG | G | VG | VG | VG | VG | VG | VG | VG |
| Ex. 54 | VG | G | VG | VG | VG | VG | VG | VG | VG |
| Ex. 55 | VG | G | VG | G | VG | G | VG | VG | VG |
| Ex. 56 | VG | VG | VG | G | VG | G | VG | VG | VG |
| Ex. 57 | VG | VG | VG | VG | VG | G | VG | VG | VG |
| Ex. 58 | VG | VG | VG | VG | VG | G | VG | VG | VG |
| Ex. 59 | VG | VG | VG | VG | VG | G | VG | VG | VG |
| Ex. 60 | VG | VG | VG | VG | VG | VG | VG | VG | VG |

TABLE 11-continued

| | GI | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Ex. 61 | VG | VG | VG | VG | VG | VG | VG | VG | VG |
| Ex. 62 | VG | VG | VG | VG | VG | VG | VG | VG | VG |
| Ex. 63 | VG | VG | VG | VG | VG | VG | VG | VG | VG |
| Ex. 64 | VG | G | VG | VG | VG | VG | VG | VG | VG |
| Ex. 65 | VG | G | VG | VG | VG | VG | VG | VG | VG |
| Ex. 66 | VG | G | VG | VG | VG | VG | VG | VG | VG |
| Ex. 67 | VG | G | VG | G | VG | VG | VG | VG | VG |
| Ex. 68 | VG | G | VG | G | VG | VG | VG | VG | VG |

TABLE 12

| | GI | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Comp. 1 | B | B | B | B | G | B | NG | NG | G |
| Comp. 2 | VG | VG | VG | B | VG | VG | NG | NG | B |
| Comp. 3 | NG | NG | G | VG | VG | NG | B | B | B |
| Comp. 4 | NG | NG | B | VG | VG | VG | NG | NG | NG |
| Comp. 5 | NG | NG | B | VG | VG | VG | NG | NG | G |
| Comp. 6 | NG | NG | B | VG | G | VG | B | B | B |
| Comp. 7 | NG | NG | B | B | VG | G | NG | NG | G |
| Comp. 8 | VG | G | VG | VG | B | G | B | B | B |
| Comp. 9 | B | B | NG | NG | G | NG | NG | NG | B |
| Comp. 10 | NG | NG | NG | B | G | VG | NG | NG | B |
| Comp. 11 | VG | G | VG | G | VG | VG | NG | NG | B |
| Comp. 12 | VG | VG | VG | VG | VG | VG | NG | B | B |

TABLE 13

| | ZL | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Ex. 1 | VG | G | VG | G | VG | VG | VG | VG | VG |
| Ex. 2 | VG | G | VG | G | VG | VG | VG | VG | VG |
| Ex. 3 | VG | VG | VG | VG | VG | VG | VG | VG | VG |
| Ex. 4 | VG | VG | VG | VG | VG | VG | VG | VG | VG |
| Ex. 5 | VG | VG | VG | VG | VG | VG | VG | VG | VG |
| Ex. 6 | VG | VG | VG | VG | VG | VG | VG | VG | VG |
| Ex. 7 | VG | VG | VG | VG | VG | VG | VG | VG | VG |
| Ex. 8 | VG | VG | VG | VG | VG | VG | VG | VG | VG |
| Ex. 9 | VG | G | VG | G | VG | VG | VG | VG | VG |
| Ex. 10 | VG | G | VG | G | VG | VG | VG | VG | VG |
| Ex. 11 | VG | VG | VG | VG | VG | VG | VG | VG | VG |
| Ex. 12 | VG | VG | VG | VG | VG | VG | VG | VG | VG |
| Ex. 13 | VG | VG | VG | VG | VG | VG | VG | VG | VG |
| Ex. 14 | G | G | VG | VG | VG | VG | VG | VG | VG |
| Ex. 15 | VG | VG | VG | VG | VG | VG | VG | VG | VG |
| Ex. 16 | VG | VG | VG | VG | VG | VG | VG | VG | VG |
| Ex. 17 | G | VG | VG | VG | VG | VG | VG | VG | VG |
| Ex. 18 | VG | VG | VG | VG | VG | VG | VG | VG | VG |
| Ex. 19 | VG | VG | VG | VG | VG | VG | VG | VG | VG |
| Ex. 20 | VG | VG | VG | VG | VG | VG | VG | VG | VG |
| Ex. 21 | VG | VG | VG | VG | VG | VG | VG | VG | VG |
| Ex. 22 | VG | VG | VG | VG | VG | VG | VG | VG | VG |
| Ex. 23 | VG | VG | VG | G | VG | G | VG | VG | VG |
| Ex. 24 | VG | VG | VG | G | VG | G | VG | VG | VG |
| Ex. 25 | VG | VG | VG | VG | VG | VG | VG | VG | VG |
| Ex. 26 | VG | G | VG | VG | VG | VG | VG | VG | VG |
| Ex. 27 | VG | VG | VG | VG | VG | VG | VG | VG | VG |
| Ex. 28 | VG | VG | VG | VG | VG | G | VG | VG | VG |

TABLE 13-continued

| | ZL | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Ex. 29 | VG | VG | VG | VG | VG | G | VG | VG | VG |
| Ex. 30 | VG | VG | VG | VG | VG | G | VG | VG | VG |
| Ex. 31 | VG | G | VG | VG | VG | G | VG | VG | VG |
| Ex. 32 | G | G | VG | VG | VG | G | VG | VG | VG |
| Ex. 33 | G | G | VG | VG | VG | VG | VG | VG | VG |
| Ex. 34 | G | G | VG | VG | VG | VG | VG | VG | VG |

TABLE 14

| | ZL | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Ex. 35 | G | G | VG | VG | VG | VG | VG | VG | VG |
| Ex. 36 | VG | G | VG | VG | VG | VG | VG | VG | VG |
| Ex. 37 | VG | G | VG | VG | VG | VG | VG | VG | VG |
| Ex. 38 | VG | G | VG | VG | VG | G | VG | VG | VG |
| Ex. 39 | VG | VG | VG | VG | VG | VG | VG | VG | VG |
| Ex. 40 | VG | VG | VG | VG | VG | VG | VG | VG | VG |
| Ex. 41 | VG | VG | VG | VG | VG | VG | VG | VG | VG |
| Ex. 42 | VG | G | VG | VG | VG | VG | VG | VG | VG |
| Ex. 43 | VG | G | VG | VG | VG | VG | VG | VG | VG |
| Ex. 44 | VG | G | VG | VG | VG | VG | VG | VG | VG |
| Ex. 45 | G | G | VG | G | VG | VG | VG | VG | VG |
| Ex. 46 | G | G | VG | G | VG | VG | VG | VG | VG |
| Ex. 47 | G | VG | VG | G | VG | VG | VG | VG | VG |
| Ex. 48 | VG | VG | VG | G | VG | VG | VG | VG | VG |
| Ex. 49 | VG | VG | VG | VG | G | VG | VG | VG | VG |
| Ex. 50 | VG | VG | VG | VG | G | VG | VG | VG | VG |
| Ex. 51 | VG | VG | VG | VG | VG | VG | VG | VG | VG |
| Ex. 52 | VG | VG | VG | VG | VG | VG | VG | VG | VG |
| Ex. 53 | VG | G | VG | VG | VG | VG | VG | VG | VG |
| Ex. 54 | VG | G | VG | VG | VG | VG | VG | VG | VG |
| Ex. 55 | VG | G | VG | G | VG | G | VG | VG | VG |
| Ex. 56 | VG | VG | VG | G | VG | G | VG | VG | VG |
| Ex. 57 | VG | VG | VG | VG | VG | G | VG | VG | VG |
| Ex. 58 | VG | VG | VG | VG | VG | G | VG | VG | VG |
| Ex. 59 | VG | VG | VG | VG | VG | G | VG | VG | VG |
| Ex. 60 | VG | VG | VG | VG | VG | VG | VG | VG | VG |
| Ex. 61 | VG | VG | VG | VG | VG | VG | VG | VG | VG |
| Ex. 62 | VG | VG | VG | VG | VG | VG | VG | VG | VG |
| Ex. 63 | VG | G | VG | VG | VG | VG | VG | VG | VG |
| Ex. 64 | VG | G | VG | VG | VG | VG | VG | VG | VG |
| Ex. 65 | VG | G | VG | VG | VG | VG | VG | VG | VG |
| Ex. 66 | VG | G | VG | VG | VG | VG | VG | VG | VG |
| Ex. 67 | VG | G | VG | G | VG | VG | VG | VG | VG |
| Ex. 68 | VG | G | VG | G | VG | VG | VG | VG | VG |

TABLE 15

| | ZL | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Comp. 1 | B | B | B | B | G | B | NG | NG | G |
| Comp. 2 | VG | VG | VG | B | VG | VG | NG | NG | B |
| Comp. 3 | NG | NG | G | VG | VG | NG | B | B | B |
| Comp. 4 | B | B | B | VG | VG | VG | NG | VG | G |
| Comp. 5 | NG | B | B | VG | VG | VG | NG | G | G |
| Comp. 6 | NG | B | B | VG | VG | VG | B | B | G |
| Comp. 7 | B | B | B | B | VG | G | NG | NG | G |
| Comp. 8 | VG | G | VG | VG | B | G | B | B | NG |

TABLE 15-continued

| | ZL | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Comp. 9 | B | B | NG | NG | VG | NG | NG | NG | NG |
| Comp. 10 | NG | B | NG | B | VG | VG | NG | NG | NG |
| Comp. 11 | VG | G | VG | G | VG | VG | B | B | B |
| Comp. 12 | VG | VG | VG | VG | VG | VG | NG | NG | B |

TABLE 16

| | GA | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Ex. 1 | VG | G | VG | G | VG | VG | VG | VG | VG |
| Ex. 2 | VG | G | VG | G | VG | VG | VG | VG | VG |
| Ex. 3 | VG | VG | VG | VG | VG | VG | VG | VG | VG |
| Ex. 4 | VG | VG | VG | VG | VG | VG | VG | VG | VG |
| Ex. 5 | VG | VG | VG | VG | VG | VG | VG | VG | VG |
| Ex. 6 | VG | VG | VG | VG | VG | VG | VG | VG | VG |
| Ex. 7 | VG | VG | VG | VG | VG | VG | G | VG | VG |
| Ex. 8 | VG | VG | VG | VG | VG | VG | VG | VG | VG |
| Ex. 9 | VG | G | VG | G | VG | VG | VG | VG | VG |
| Ex. 10 | VG | G | VG | G | VG | VG | VG | VG | VG |
| Ex. 11 | VG | VG | VG | VG | VG | VG | VG | VG | VG |
| Ex. 12 | VG | VG | VG | VG | VG | VG | VG | VG | G |
| Ex. 13 | VG | VG | VG | VG | VG | VG | VG | VG | VG |
| Ex. 14 | VG | G | VG | VG | VG | VG | VG | VG | VG |
| Ex. 15 | VG | VG | VG | VG | VG | VG | VG | VG | VG |
| Ex. 16 | VG | VG | VG | VG | VG | VG | VG | VG | VG |
| Ex. 17 | VG | VG | VG | VG | VG | VG | VG | VG | VG |
| Ex. 18 | VG | VG | VG | VG | VG | VG | VG | VG | VG |
| Ex. 19 | VG | VG | VG | VG | VG | VG | VG | VG | VG |
| Ex. 20 | VG | VG | VG | VG | VG | VG | VG | VG | VG |
| Ex. 21 | VG | VG | VG | VG | VG | VG | VG | VG | VG |
| Ex. 22 | VG | VG | VG | VG | VG | VG | VG | VG | VG |
| Ex. 23 | VG | VG | VG | G | VG | G | VG | G | VG |
| Ex. 24 | VG | VG | VG | G | VG | G | VG | VG | VG |
| Ex. 25 | VG | VG | VG | VG | VG | VG | VG | VG | VG |
| Ex. 26 | VG | G | VG | VG | VG | VG | VG | VG | VG |
| Ex. 27 | VG | VG | VG | VG | VG | VG | VG | VG | VG |
| Ex. 28 | VG | VG | VG | VG | VG | G | VG | VG | VG |
| Ex. 29 | VG | VG | G | VG | VG | G | VG | VG | VG |
| Ex. 30 | VG | VG | G | VG | VG | G | VG | VG | VG |
| Ex. 31 | VG | G | G | VG | VG | G | VG | VG | VG |
| Ex. 32 | VG | G | G | VG | VG | G | VG | VG | VG |
| Ex. 33 | VG | G | G | VG | VG | VG | VG | VG | VG |
| Ex. 34 | VG | G | G | VG | VG | VG | VG | VG | G |

TABLE 17

| | GA | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Ex. 35 | VG | G | G | VG | VG | VG | VG | VG | VG |
| Ex. 36 | VG | G | G | VG | VG | VG | VG | VG | VG |
| Ex. 37 | VG | G | G | VG | VG | VG | VG | VG | VG |
| Ex. 38 | VG | G | G | VG | VG | G | VG | VG | VG |
| Ex. 39 | VG | VG | VG | VG | VG | VG | VG | VG | VG |
| Ex. 40 | VG | VG | VG | VG | VG | VG | VG | VG | VG |
| Ex. 41 | VG | VG | VG | VG | VG | VG | VG | VG | VG |
| Ex. 42 | VG | G | VG | VG | VG | VG | VG | VG | VG |
| Ex. 43 | VG | G | VG | VG | VG | VG | VG | VG | VG |
| Ex. 44 | VG | G | VG | VG | VG | VG | VG | VG | VG |

TABLE 17-continued

| | GA | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Ex. 45 | G | G | VG | G | VG | VG | VG | VG | VG |
| Ex. 46 | G | G | VG | G | VG | VG | VG | VG | VG |
| Ex. 47 | G | VG | VG | G | VG | VG | VG | VG | VG |
| Ex. 48 | VG | VG | VG | G | VG | VG | VG | VG | VG |
| Ex. 49 | VG | VG | VG | VG | VG | VG | VG | VG | VG |
| Ex. 50 | VG | VG | VG | VG | VG | VG | VG | VG | VG |
| Ex. 51 | VG | VG | VG | VG | VG | VG | VG | VG | VG |
| Ex. 52 | VG | VG | VG | VG | VG | VG | VG | VG | VG |
| Ex. 53 | VG | G | VG | VG | G | VG | VG | VG | VG |
| Ex. 54 | VG | G | VG | VG | G | VG | VG | VG | VG |
| Ex. 55 | VG | G | VG | G | VG | G | VG | VG | VG |
| Ex. 56 | VG | VG | VG | G | VG | G | VG | VG | VG |
| Ex. 57 | VG | VG | VG | VG | VG | G | VG | VG | VG |
| Ex. 58 | VG | VG | VG | VG | VG | G | VG | VG | VG |
| Ex. 59 | VG | VG | VG | VG | VG | G | VG | VG | VG |
| Ex. 60 | VG | VG | VG | VG | VG | VG | VG | VG | VG |
| Ex. 61 | VG | VG | VG | VG | VG | VG | VG | VG | VG |
| Ex. 62 | VG | VG | VG | VG | VG | VG | VG | VG | VG |
| Ex. 63 | VG | G | VG | VG | VG | VG | VG | VG | VG |
| Ex. 64 | VG | G | VG | VG | VG | VG | VG | VG | VG |
| Ex. 65 | VG | G | VG | VG | VG | VG | VG | VG | VG |
| Ex. 66 | VG | G | VG | VG | VG | VG | VG | VG | VG |
| Ex. 67 | VG | G | VG | G | VG | VG | VG | VG | VG |
| Ex. 68 | VG | G | VG | G | VG | VG | VG | VG | VG |

TABLE 18

| | GA | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Comp. 1 | B | B | B | B | G | B | NG | NG | G |
| Comp. 2 | VG | VG | VG | B | VG | VG | NG | NG | B |
| Comp. 3 | NG | NG | G | VG | VG | NG | B | B | B |
| Comp. 4 | B | B | B | VG | VG | VG | NG | VG | G |
| Comp. 5 | NG | B | B | VG | VG | VG | NG | G | G |
| Comp. 6 | NG | B | B | VG | VG | VG | B | B | G |
| Comp. 7 | B | B | B | B | VG | G | NG | NG | G |
| Comp. 8 | VG | G | VG | VG | B | G | B | B | NG |
| Comp. 9 | B | B | NG | NG | VG | NG | NG | NG | NG |
| Comp. 10 | NG | B | NG | B | VG | VG | NG | NG | NG |
| Comp. 11 | VG | G | VG | G | VG | VG | NG | NG | B |
| Comp. 12 | VG | VG | VG | VG | B | VG | B | B | B |

TABLE 19

| | SD | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Ex. 1 | VG | VG | VG | G | VG | VG | VG | VG | VG |
| Ex. 2 | VG | VG | VG | G | VG | VG | VG | VG | VG |
| Ex. 3 | VG | VG | VG | VG | VG | VG | VG | VG | VG |
| Ex. 4 | VG | VG | VG | VG | VG | VG | VG | VG | VG |
| Ex. 5 | VG | VG | VG | VG | VG | VG | VG | VG | VG |
| Ex. 6 | VG | VG | VG | VG | VG | VG | G | VG | VG |
| Ex. 7 | VG | VG | VG | VG | VG | VG | VG | VG | VG |
| Ex. 8 | VG | VG | VG | VG | VG | VG | VG | VG | VG |
| Ex. 9 | VG | VG | VG | G | VG | VG | VG | VG | VG |
| Ex. 10 | VG | VG | VG | G | VG | VG | VG | VG | VG |
| Ex. 11 | VG | VG | VG | VG | VG | VG | VG | VG | G |
| Ex. 12 | VG | VG | VG | VG | VG | VG | VG | VG | VG |

TABLE 19-continued

| | SST | | SD | | | | | | |
|---|---|---|---|---|---|---|---|---|---|
| | Planar Section | Processed Section | Heat Resistance | Fingerprint Resistance | Solvent Resistance | Painting Property | Sliding Mobility | Damage Resistance | Dreg Resistance |
| Ex. 13 | VG | VG | VG | VG | VG | VG | VG | VG | VG |
| Ex. 14 | VG | VG | VG | VG | VG | VG | VG | VG | VG |
| Ex. 15 | VG | VG | VG | VG | VG | VG | VG | VG | VG |
| Ex. 16 | VG | VG | VG | VG | VG | VG | VG | VG | VG |
| Ex. 17 | VG | VG | VG | VG | VG | VG | VG | VG | VG |
| Ex. 18 | VG | VG | VG | VG | VG | VG | VG | VG | VG |
| Ex. 19 | VG | VG | VG | VG | VG | VG | VG | VG | VG |
| Ex. 20 | VG | VG | VG | VG | VG | VG | VG | VG | VG |
| Ex. 21 | VG | VG | VG | VG | VG | VG | VG | G | VG |
| Ex. 22 | VG | VG | VG | VG | VG | VG | VG | VG | VG |
| Ex. 23 | VG | VG | VG | G | VG | G | VG | VG | VG |
| Ex. 24 | VG | VG | VG | G | VG | G | VG | VG | VG |
| Ex. 25 | VG | VG | VG | VG | VG | VG | VG | VG | VG |
| Ex. 26 | VG | G | VG | VG | VG | VG | VG | VG | VG |
| Ex. 27 | VG | VG | VG | VG | VG | VG | VG | VG | VG |
| Ex. 28 | VG | VG | VG | VG | VG | G | VG | VG | G |
| Ex. 29 | VG | VG | G | VG | VG | G | VG | VG | VG |
| Ex. 30 | VG | VG | G | VG | VG | G | VG | VG | VG |
| Ex. 31 | G | G | G | VG | VG | G | VG | VG | VG |
| Ex. 32 | G | G | G | VG | VG | G | VG | VG | VG |
| Ex. 33 | VG | VG | G | VG | VG | VG | VG | VG | VG |
| Ex. 34 | VG | VG | G | VG | VG | VG | VG | VG | VG |

TABLE 20

| | SST | | SD | | | | | | |
|---|---|---|---|---|---|---|---|---|---|
| | Planar Section | Processed Section | Heat Resistance | Fingerprint Resistance | Solvent Resistance | Painting Property | Sliding Mobility | Damage Resistance | Dreg Resistance |
| Ex. 35 | VG | VG | G | VG | VG | VG | VG | VG | VG |
| Ex. 36 | VG | VG | G | VG | VG | VG | VG | VG | VG |
| Ex. 37 | VG | VG | G | VG | VG | VG | VG | VG | VG |
| Ex. 38 | VG | VG | G | VG | VG | G | G | VG | VG |
| Ex. 39 | VG | VG | VG | VG | VG | VG | VG | VG | VG |
| Ex. 40 | VG | VG | VG | VG | VG | VG | VG | VG | VG |
| Ex. 41 | VG | VG | VG | VG | VG | VG | VG | VG | VG |
| Ex. 42 | VG | VG | VG | VG | VG | VG | VG | VG | VG |
| Ex. 43 | VG | VG | VG | VG | VG | VG | VG | VG | VG |
| Ex. 44 | VG | VG | VG | VG | VG | VG | VG | VG | VG |
| Ex. 45 | VG | VG | G | G | VG | VG | VG | VG | VG |
| Ex. 46 | VG | VG | G | G | VG | VG | VG | VG | VG |
| Ex. 47 | VG | VG | G | G | G | VG | VG | VG | VG |
| Ex. 48 | VG | VG | VG | G | G | VG | VG | VG | G |
| Ex. 49 | VG | VG | VG | VG | G | VG | VG | VG | VG |
| Ex. 50 | VG | VG | VG | VG | G | VG | VG | VG | VG |
| Ex. 51 | VG | VG | VG | VG | VG | VG | VG | VG | VG |
| Ex. 52 | VG | VG | VG | VG | VG | VG | VG | VG | VG |
| Ex. 53 | VG | VG | VG | VG | VG | VG | VG | VG | VG |
| Ex. 54 | VG | VG | VG | VG | VG | VG | VG | VG | VG |
| Ex. 55 | VG | VG | VG | G | VG | G | VG | VG | VG |
| Ex. 56 | VG | VG | VG | G | VG | G | VG | VG | VG |
| Ex. 57 | VG | VG | VG | VG | VG | G | VG | VG | VG |
| Ex. 58 | VG | VG | VG | VG | VG | G | VG | VG | VG |
| Ex. 59 | VG | VG | VG | VG | VG | G | VG | VG | VG |
| Ex. 60 | VG | VG | VG | VG | VG | VG | VG | VG | VG |
| Ex. 61 | VG | VG | VG | VG | VG | VG | VG | VG | VG |
| Ex. 62 | VG | VG | VG | VG | VG | VG | VG | VG | VG |
| Ex. 63 | VG | VG | VG | VG | VG | VG | VG | VG | VG |
| Ex. 64 | VG | VG | VG | VG | VG | VG | VG | VG | VG |
| Ex. 65 | VG | VG | VG | VG | VG | VG | VG | VG | VG |
| Ex. 66 | VG | VG | VG | VG | VG | VG | VG | VG | VG |
| Ex. 67 | VG | VG | VG | G | VG | VG | VG | VG | VG |
| Ex. 68 | VG | VG | VG | G | VG | VG | VG | VG | VG |

TABLE 21

| | SD | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Comp. 1 | B | B | B | B | G | B | NG | NG | G |
| Comp. 2 | VG | VG | VG | B | VG | VG | NG | NG | G |
| Comp. 3 | NG | NG | G | VG | VG | NG | B | B | B |
| Comp. 4 | NG | NG | B | VG | VG | VG | NG | VG | G |
| Comp. 5 | NG | NG | B | VG | VG | VG | NG | G | G |
| Comp. 6 | NG | NG | B | VG | VG | VG | B | B | G |
| Comp. 7 | NG | NG | B | B | VG | G | NG | NG | G |
| Comp. 8 | VG | G | VG | VG | B | G | B | B | NG |
| Comp. 9 | B | B | NG | NG | VG | NG | NG | NG | NG |
| Comp. 10 | NG | NG | NG | B | VG | VG | NG | NG | NG |
| Comp. 11 | VG | VG | VG | G | VG | VG | B | B | B |
| Comp. 12 | VG | VG | VG | VG | VG | VG | NG | NG | B |

TABLE 22

| | GL | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Ex. 1 | VG | VG | VG | G | VG | VG | VG | VG | VG |
| Ex. 2 | VG | VG | VG | G | VG | VG | VG | VG | VG |
| Ex. 3 | VG | VG | VG | VG | VG | VG | VG | VG | VG |
| Ex. 4 | VG | VG | VG | VG | VG | VG | VG | VG | VG |
| Ex. 5 | VG | VG | VG | VG | VG | VG | VG | VG | VG |
| Ex. 6 | VG | VG | VG | VG | VG | VG | G | VG | VG |
| Ex. 7 | VG | VG | VG | VG | VG | VG | VG | VG | VG |
| Ex. 8 | VG | VG | VG | VG | VG | VG | VG | VG | VG |
| Ex. 9 | VG | VG | VG | G | VG | VG | VG | VG | VG |
| Ex. 10 | VG | VG | VG | G | VG | VG | VG | VG | VG |
| Ex. 11 | VG | VG | VG | VG | VG | VG | VG | VG | G |
| Ex. 12 | VG | VG | VG | VG | VG | VG | VG | VG | VG |
| Ex. 13 | VG | VG | VG | VG | VG | VG | VG | VG | VG |
| Ex. 14 | VG | VG | VG | VG | VG | VG | VG | VG | VG |
| Ex. 15 | VG | VG | VG | VG | VG | VG | VG | VG | VG |
| Ex. 16 | VG | VG | VG | VG | VG | VG | VG | VG | VG |
| Ex. 17 | VG | VG | VG | VG | VG | VG | VG | VG | VG |
| Ex. 18 | VG | VG | VG | VG | VG | VG | VG | VG | VG |
| Ex. 19 | VG | VG | VG | VG | VG | VG | VG | VG | VG |
| Ex. 20 | VG | VG | VG | VG | VG | VG | VG | VG | VG |
| Ex. 21 | VG | VG | VG | VG | VG | VG | VG | G | VG |
| Ex. 22 | VG | VG | VG | VG | VG | VG | VG | VG | VG |
| Ex. 23 | VG | VG | VG | G | VG | G | VG | VG | VG |
| Ex. 24 | VG | VG | VG | G | VG | G | VG | VG | VG |
| Ex. 25 | VG | VG | VG | VG | VG | VG | VG | VG | VG |
| Ex. 26 | VG | G | VG | VG | VG | VG | VG | VG | VG |
| Ex. 27 | VG | VG | VG | VG | VG | VG | VG | VG | VG |
| Ex. 28 | VG | VG | VG | VG | VG | G | VG | VG | G |
| Ex. 29 | VG | VG | G | VG | VG | G | VG | VG | VG |
| Ex. 30 | VG | VG | G | VG | VG | G | VG | VG | VG |
| Ex. 31 | G | G | G | VG | VG | G | VG | VG | VG |
| Ex. 32 | G | G | G | VG | VG | G | VG | VG | VG |
| Ex. 33 | VG | VG | G | VG | VG | VG | VG | VG | VG |
| Ex. 34 | VG | VG | G | VG | VG | VG | VG | VG | VG |

TABLE 23

| | GL | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Ex. 35 | VG | VG | G | VG | VG | VG | VG | VG | VG |
| Ex. 36 | VG | VG | G | VG | VG | VG | VG | VG | VG |

TABLE 23-continued

| | GL | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Ex. 37 | VG | VG | G | VG | VG | VG | VG | VG | VG |
| Ex. 38 | VG | VG | G | VG | VG | G | G | VG | VG |
| Ex. 39 | VG | VG | VG | VG | VG | VG | VG | VG | VG |
| Ex. 40 | VG | VG | VG | VG | VG | VG | VG | VG | VG |
| Ex. 41 | VG | VG | VG | VG | VG | VG | VG | VG | VG |
| Ex. 42 | VG | VG | VG | VG | VG | VG | VG | VG | VG |
| Ex. 43 | VG | VG | VG | VG | VG | VG | VG | VG | VG |
| Ex. 44 | VG | VG | VG | VG | VG | VG | VG | VG | VG |
| Ex. 45 | VG | VG | G | G | VG | VG | VG | VG | VG |
| Ex. 46 | VG | VG | G | G | VG | VG | VG | VG | VG |
| Ex. 47 | VG | VG | G | G | G | VG | VG | VG | VG |
| Ex. 48 | VG | VG | VG | G | G | VG | VG | VG | G |
| Ex. 49 | VG | VG | VG | VG | G | VG | VG | VG | VG |
| Ex. 50 | VG | VG | VG | VG | G | VG | VG | VG | VG |
| Ex. 51 | VG | VG | VG | VG | VG | VG | VG | VG | VG |
| Ex. 52 | VG | VG | VG | VG | VG | VG | VG | VG | VG |
| Ex. 53 | VG | VG | VG | VG | VG | VG | VG | VG | VG |
| Ex. 54 | VG | VG | VG | VG | VG | VG | VG | VG | VG |
| Ex. 55 | VG | VG | VG | G | VG | G | VG | VG | VG |
| Ex. 56 | VG | VG | VG | G | VG | G | VG | VG | VG |
| Ex. 57 | VG | VG | VG | VG | VG | G | VG | VG | VG |
| Ex. 58 | VG | VG | VG | VG | VG | G | VG | VG | VG |
| Ex. 59 | VG | VG | VG | VG | VG | G | VG | VG | VG |
| Ex. 60 | VG | VG | VG | VG | VG | VG | VG | VG | VG |
| Ex. 61 | VG | VG | VG | VG | VG | VG | VG | VG | VG |
| Ex. 62 | VG | VG | VG | VG | VG | VG | VG | VG | VG |
| Ex. 63 | VG | VG | VG | VG | VG | VG | VG | VG | VG |
| Ex. 64 | VG | VG | VG | VG | VG | VG | VG | VG | VG |
| Ex. 65 | VG | VG | VG | VG | VG | VG | VG | VG | VG |
| Ex. 66 | VG | VG | VG | VG | VG | VG | VG | VG | VG |
| Ex. 67 | VG | VG | VG | G | VG | VG | VG | VG | VG |
| Ex. 68 | VG | VG | VG | G | VG | VG | VG | VG | VG |

TABLE 24

| | GL | | | | | | | | |
|---|---|---|---|---|---|---|---|---|---|
| | SST | | | | | | | | |
| | Planar Section | Processed Section | Heat Resistance | Fingerprint Resistance | Solvent Resistance | Painting Property | Sliding Mobility | Damage Resistance | Dreg Resistance |
| Comp. 1 | B | B | B | B | G | B | NG | NG | G |
| Comp. 2 | VG | VG | VG | B | VG | VG | NG | NG | B |
| Comp. 3 | NG | NG | G | VG | VG | NG | B | B | B |
| Comp. 4 | NG | NG | B | VG | VG | VG | NG | VG | G |
| Comp. 5 | G | NG | B | VG | VG | VG | NG | G | G |
| Comp. 6 | G | NG | B | VG | VG | VG | B | B | G |
| Comp. 7 | NG | B | B | B | VG | G | NG | NG | G |
| Comp. 8 | VG | G | VG | VG | B | G | B | B | NG |
| Comp. 9 | B | B | NG | NG | VG | NG | NG | NG | NG |
| Comp. 10 | NG | B | NG | B | VG | VG | NG | NG | NG |
| Comp. 11 | VG | G | VG | G | VG | VG | B | B | B |
| Comp. 12 | VG | VG | VG | VG | VG | VG | NG | NG | B |

As described above, the embodiments suitable for the invention have been described, but it is natural that the invention is not limited to such examples. It is possible that a person skilled in the art imagines varied examples and modified examples within the scope described in the claims, and it is considered that such examples fall within the technical scope of the invention.

INDUSTRIAL APPLICABILITY

It is possible to provide a metal material subjected to a chrome free surface treatment that can satisfy all of corrosion resistance, heat resistance, solvent resistance, a paintability, a sliding mobility, damage resistance at the time of forming, and dreg resistance.

The invention claimed is:

1. A surface-treated metal material comprising a composite film formed on a surface of a metal material, the composite film containing:

an organic silicon compound (W) having two or more functional groups (a) represented by Formula $SiR^1R^2R^3$, where each of $R^1$, $R^2$ and $R^3$ represents an alkoxy group or a hydroxyl group independently from each other, and at least one of them represents an alkoxy group; and one or more hydrophilic functional group (b) of at least one kind selected from a hydroxyl group different from what can be included in the functional group (a) and an amino group, in a molecule, wherein the organic silicon compound (W) has an average molecular weight of 1000 to 10000;

at least one kind of fluorine compound (X) selected from titanium hydrofluoric acid and zirconium hydrofluoric acid;

a phosphoric acid (Y);

a vanadium compound (Z); and at least one kind of lubricant (J) selected from the group consisting of water dispersible polyethylene wax, polypropylene wax, and polytetrafluoroethylene and has a number average particle size of 0.01 μm to 1.0 μm and a softening temperature of 100° C. or more, wherein the organic silicon compound (W) is obtained by combining a silane coupling agent (A) containing one amino group in a molecule and a silane coupling agent (B) containing one glycidyl group in a molecule, at a solid content mass ratio (A)/(B) of 0.5 to 1.7; and ratios of components of the composite film satisfy the following conditions (1) to (5), respectively:

(1) a solid content mass ratio (X)/(W) of the organic silicon compound (W) and the fluorine compound (X) is in the range of $0.02 \leqq (X)/(W) \leqq 0.07$, (2) a solid content mass ratio (Y)/(W) of the organic silicon compound (W) and the phosphoric acid (Y) is in the range of $0.03 \leqq (Y)/(W) \leqq 0.12$, (3) a solid content mass ratio (Z)/(W) of the organic silicon compound (W) and the vanadium compound (Z) is in the range of $0.05 \leqq (Z)/(W) \leqq 0.17$, (4) a solid content mass ratio (Z)/(X) of the fluorine compound (X) and the vanadium compound (Z) is in the range of $1.3 \leqq (Z)/(X) \leqq 6.0$, and (5) a solid content mass ratio (J)/(W+X+Y+Z) of the lubricant (J); and the organic silicon compound (W), the fluorine compound (X), the phosphoric acid (Y), and the vanadium compound (Z) is in the range of $0.02 \leqq (J)/(W+X+Y+Z) \leqq 0.12$.

2. The surface-treated metal material according to claim 1, wherein the composite film further contains at least one kind of cobalt compound (C) selected from the group consisting of cobalt sulfate, cobalt nitrate, and cobalt carbonate, in which a solid content mass ratio (C)/(W) of the organic silicon compound (W) and the cobalt compound (C) is in the range of 0.01 to 0.1.

3. The surface-treated metal material according to claim 1, wherein a film weight of the composite film after drying is in the range of 0.05 g/m$^2$ to 2.0 g/m$^2$.

4. The surface-treated metal material according to claim 1, wherein the metal material is a zinc plated steel sheet.

5. A method of producing a surface-treated metal material, the method comprising the steps of:

applying an aqueous metal surface treatment agent satisfying the following conditions (1) to (7) onto a surface of a metal material; and drying the aqueous metal surface treatment agent at a temperature of more than 50° C. and less than 250° C. so that a film weight is in the range of 0.05 g/m$^2$ to 2.0 g/m$^2$, wherein (1) the aqueous metal surface treatment agent contains an organic silicon compound (W) having two or more functional groups (a) represented by Formula $SiR^1R^2R^3$, where each of $R^1$, $R^2$ and $R^3$ represents an alkoxy group or a hydroxyl group independently from each other, and at least one of them represents an alkoxy group; and one or more hydrophilic functional group (b) of at least one kind selected from a hydroxyl group different from what can be included in the functional group (a) and an amino group, in a molecule, wherein the organic silicon compound (W) has an average molecular weight of 1000 to 10000; at least one kind fluorine compound (X) selected from titanium hydrofluoric acid and zirconium hydrofluoric acid; a phosphoric acid (Y); a vanadium compound (Z); and at least one kind lubricant (J) selected from the group consisting of water dispersible polyethylene wax, polypropylene wax, and polytetrafluoroethylene and has a number average particle size of 0.01 μm to 1.0 μm and a softening temperature of 100° C. or more, (2) the organic silicon compound (W) is obtained by combining a silane coupling agent (A) containing one amino group in a molecule and one glycidyl group in a molecule, at a solid content mass ratio (A)/(B) of 0.5 to 1.7, (3) a solid content mass ratio (X)/(W) of the organic silicon compound (W) and the fluorine compound (X) is in the range of $0.02 \leqq (X)/(W) \leqq 0.07$, (4) a solid content mass ratio (Y)/(W) of the organic silicon compound (W) and the phosphoric acid (Y) is in the range of $0.03 \leqq (Y)/(W) \leqq 0.12$, (5) a solid content mass ratio (Z)/(W) of the organic silicon compound (W) and the vanadium compound (Z) is in the range of $0.05 \leqq (Z)/(W) \leqq 0.17$, (6) a solid content mass ratio (Z)/(X) of the fluorine compound (X) and the vanadium compound (Z) is in the range of $1.3 \leqq (Z)/(X) \leqq 6.0$, and (7) a solid content mass ratio (J)/(W+X+Y+Z) of the lubricant (J) and the components except the lubricant (J) is in the range of $0.02 \leqq (J)/(W+X+Y+Z) \leqq 0.12$.

* * * * *

UNITED STATES PATENT AND TRADEMARK OFFICE

CERTIFICATE OF CORRECTION

PATENT NO. : 8,241,744 B2
APPLICATION NO. : 12/312429
DATED : August 14, 2012
INVENTOR(S) : Ikuo Kikuchi et al.

It is certified that error appears in the above-identified patent and that said Letters Patent is hereby corrected as shown below:

In the Specifications

Column 1, line 14, change "2006-309614," to --2006-309614, filed November 15, 2006,--.

Column 3, line 41, change "SI $R^1$ $R^2$ $R^3$" to --Si $R^1$ $R^2$ $R^3$--.

Signed and Sealed this
Twenty-fourth Day of December, 2013

Margaret A. Focarino

Margaret A. Focarino
*Commissioner for Patents of the United States Patent and Trademark Office*